US012371803B2

(12) United States Patent
Hu et al.

(10) Patent No.: US 12,371,803 B2
(45) **Date of Patent: *Jul. 29, 2025**

(54) PERFORATED MEMBRANES FOR THE EFFICIENT CONVERSION OF CARBON MONOXIDE TO ORGANIC COMPOUNDS

(71) Applicant: Alliance for Sustainable Energy, LLC, Golden, CO (US)

(72) Inventors: Leiming Hu, Wheat Ridge, CO (US); Kenneth Charles Neyerlin, Arvada, CO (US)

(73) Assignee: Alliance for Sustainable Energy, LLC, Golden, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/460,186

(22) Filed: Sep. 1, 2023

(65) Prior Publication Data

US 2024/0191366 A1 Jun. 13, 2024

Related U.S. Application Data

(63) Continuation-in-part of application No. 18/333,391, filed on Jun. 12, 2023.

(60) Provisional application No. 63/386,711, filed on Dec. 9, 2022.

(51) Int. Cl.

| | |
|---|---|
| ***C25B 3/07*** | (2021.01) |
| ***C25B 3/26*** | (2021.01) |
| ***C25B 9/23*** | (2021.01) |
| ***C25B 11/031*** | (2021.01) |
| ***C25B 11/052*** | (2021.01) |
| ***C25B 11/065*** | (2021.01) |

(Continued)

(52) U.S. Cl.

CPC ..... *C25B 3/07* (2021.01); *C25B 3/26* (2021.01); *C25B 9/23* (2021.01); *C25B 11/031* (2021.01); *C25B 11/052* (2021.01); *C25B 11/065* (2021.01); *C25B 11/081* (2021.01); *C25B 13/02* (2013.01)

(58) Field of Classification Search

None

See application file for complete search history.

(56) References Cited

U.S. PATENT DOCUMENTS

| | | | |
|---|---|---|---|
| 6,811,905 | B1 | 11/2004 | Cropley et al. |
| 2014/0116874 | A1 | 5/2014 | Planque |
| 2019/0127865 | A1* | 5/2019 | Li ..... C25B 3/26 |

(Continued)

FOREIGN PATENT DOCUMENTS

| | | | |
|---|---|---|---|
| WO | 2020232143 | A1 | 11/2020 |
| WO | 2022155754 | A1 | 7/2022 |

OTHER PUBLICATIONS

Xu et al. (Joule 6, 1333-1343, Jun. 15, 2022 with supplemental information (Year: 2022).*

(Continued)

*Primary Examiner* — Wojciech Haske

(74) *Attorney, Agent, or Firm* — Neal S. Vickery

(57) ABSTRACT

Described herein are devices and methods for the facile, efficient electrocatalytic conversion of carbon monoxide to high purity formic acid and other organic compounds. The described devices utilize perforated membranes to reduce energy requirements and extend electrochemical cell life by reducing damage caused by fluids being formed between internal ion exchange membranes.

17 Claims, 37 Drawing Sheets

(51) Int. Cl.
*C25B 11/081* (2021.01)
*C25B 13/02* (2006.01)

(56) References Cited

U.S. PATENT DOCUMENTS

2020/0101421 A1 4/2020 Abu-Ghdaib et al.
2020/0161684 A1 5/2020 Yan et al.
2022/0010437 A1 1/2022 Kuhl et al.

OTHER PUBLICATIONS

PCT Search Report and Written Opinion from corresponding PCT/US23/83312, dated Apr. 24, 2024, 7 pages total.
Berlinguette, C.P. et al., "Voltage Matters When Reducing CO2 in an Electrochemical Flow Cell," ACS Energy Letters, vol. 5, 2020, 6 pages.
Bondarenko, M.P. et al., "Electro-osmo-dialysis through nanoporous layers physically conjugated to micro-perforated ion-exchange membranes: Highly selective accululation of trace coions," Journal of Membrane Science, vol. 622, 2021, 17 pages.
Caja, J. et al., "Characteristics of Thin-Layer Cells with Nafion Separators," ACS Anal. Chem., vol. 52, 1980, 4 pages.
Chen, Y. et al., "A Robust, Scalable Platform for the Electrochemical Conversion of CO2 to Formate: Identifying Pathways to Higher Energy Efficiencies," ACS Energy Letters, vol. 5, 2020, 9 pages.
De Mot, B. et al., "Direct Water Injection in Catholyte-Free Zero-Gap Carbon Dioxide Electrolyzers," ChemElectroChem, vol. 7, 2020, 5 pages.
Disch, J. et al., "Bipolar Membrane with Porous Anion Exchange Layer for Efficient and Long-Term Stable Electrochemical Reduction of CO2 to CO," Advanced Energy Materials, Research Article, 2023, 9 pages.
Fujiwara, N. et al., "Direct ethanol fuel cells using an ion exchange membrane," Journal of Power Sources, vol. 185, 2008, 6 pages.
Gabardo, C.M. et al., "Continuous Carbon Dioxide Electroreduction to Concentrated Multi-carbon Products Using a Membrane Electrode Assembly," Joule, vol. 3, 2019, 16 pages.
Gong, Q. et al., "Structural defects on converted bismuth oxide nanotubes enable highly active electrocatalysis of carbon dioxide reduction," Nature Communications, 2019, 10 pages.
Gutierrez-Sanchez, O. et al., "Engineering Aspects for the Design of a Bicarbonate Zero-Gap Flow Electrolyzer for the Conversion of CO2 to Formate," Applied Materials & Interfaces, vol. 14, 2022, 12 pages.
Han, N. et al., "Promises of Main Group Metal-Based Nanostructured Materials for Electrochemical CO2 Reduction to Formate," Advanced Energy Materials, Progress Report, vol. 10, 2020, 19 pages.
Hong and Chen, "Evaluation of electrochemical properties and reverse electrodialysis performance for porous cation exchange membranes with sulfate-functionalized iron oxide," Journal of Membrane Science, 2015, vol. 473, 8 pages.
Hung, S-F., "Electrochemical flow systems enable renewable energy industrial chain of CO2 reduction," Pure Appl. Chem. vol. 92, No. 12, 2020, 15 pages.
Jones, J-P et al., "Electrochemical CO2 Reduction: Recent Advances and Current Trends," Israel Journal of Chemistry, vol. 54, 2014, 16 pages.
Kaur, A. et al., "Challenges in scale-up of electrochemical CO2 reduction to formate integrated with product extraction using electrodialysis," Journal of Chemical Technology and Biotechnology, Research Article, 2021, vol. 96, 11 pages.
Klayson, C. et al., "Preparation of porous ion-exchange membranes (IEMs) and their characterizations," Journal of Membrane Science, 2011, vol. 371, 8 pages.
Lee, S. et al., "Electrodeposited Silver Nanowire Transparent Conducting Electrodes for Thin-Film Solar Cells," Applied Materials & Interfaces, vol. 12, 2020, 7 pages.
Lee, W. et al., "Catholyte-Free Electrocatalytic CO2 Reduction to Formate," Angewandte Chemie, International Edition, vol. 57, 2018, 5 pages.
Li, Y.C. et al., "Bipolar Membranes Inhibit Product Crossover in CO2 Electrolysis Cells," Advanced Sustainable Systems, vol. 2, 2018, 5 pages.
Lin, R. et al., "Electrochemical Reactors for CO2 Conversion," Catalysts, vol. 10, No. 473, 2020, 34 pages.
Ma, D. et al., "An overview of flow cell architecture design and optimization for electrochemical CO2 reduction," Journal of Materials Chemistry A, vol. 9, 2021, 22 pages.
Matz, S. et al., "Hydrogen-powered Electrochemically-driven CO2 Removal from Air Conditioning 400 to 5000 ppm CO2," Journal of the Electrochemical Society, vol. 169, 2022, 11 pages.
O'Brien, C.P. et al., "Single Pass CO2 Conversion Exceeding 85% in the Electrosynthesis of Multicarbon Products via Local CO2 Regeneration," ACS Energy Letters, vol. 6, 2021, 8 pages.
Pribyl-Kranewitter, B. et al.., "Investigation and Optimisation of Operating Conditions for Low-Temperature CO2 Reduction to CO in a Forward-Bias Bipolar-Membrane Electrolyser," Journal of the Electrochemical Society, vol. 168, 2021, 14 pages.
Senthikumar, P. et al., "The inchoate horizon of electrolyzer designs, membranes and catalysts towards highly efficient electrochemical reduction of CO2 to formic acid," RSC Advances, vol. 12, 2022, 23 pages.
Shi, L. et al., "A shorted membrane electrochemical cell powered by hydrogen to remove CO2 from the air feed of hydroxide exchange membrane fuel cells," Nature Energy, vol. 7, Mar. 2022, 10 pages.
Tufa, R.A. et al., "Towards highly efficient electrochemical CO2 reduction: Cell designs, membranes and electrocatalysts," Applied Energy, vol. 277, 2020, 5 pages.
Weekes, D.M. et al., "Electrolytic Co2 Reduction in a Flow Cell," Accounts of Chemical Research, vol. 51, 2018, 9 pages.
Xia, C. et al., "Continuous production of pure liquid fuel solutions via electrocatalytic CO2 reduction using solid-electrolyte devices," Nature Energy, 2019, 10 pages.
Xu, Y. et al., "A microchanneled solid electrolyte for carbon-efficient CO2 electrolysis," Joule, vol. 6, Jun. 15, 2022, 11 pages.
Yaroshchuk, A. et al., "Asymmetric electroosmotic pumping across porous media sandwiched with perforated ion-exchange membranes," RSC Faraday Discussions, vol. 199, No. 175, 2017, 19 pages.
Liu, L-X. et al., "Tuning Sn3O4 for CO2 reduction to formate with ultra-high current density," Nano Energy, vol. 77, 2020, 9 pages.

* cited by examiner

Toray paper,
no MPL

Patterned 117 CCM with
Pt/HSC and perforated

Versogen 80 um

Cathode GDE
Rod Bi2O3 + HNN8

PERFORATED MEMBRANES FOR THE EFFICIENT CONVERSION OF CARBON MONOXIDE TO ORGANIC COMPOUNDS

CROSS-REFERENCE TO RELATED APPLICATIONS

This application claims priority from U.S. Provisional Patent Application No. 63/386,711, filed on Dec. 9, 2022, and is a continuation-in-part of U.S. patent application Ser. No. 18/333,391, filed on Jun. 12, 2023, the contents of both of which are incorporated herein by reference in their entirety.

CONTRACTUAL ORIGIN

This invention was made with government support under Contract No. DE-AC36-08GO28308 awarded by the Department of Energy. The government has certain rights in the invention.

BACKGROUND

The electrocatalytic conversion of carbon monoxide into useful products such as formic acid is an important step in the reduction of atmospheric carbon monoxide levels and achieving a carbon neutral energy economy. Unfortunately, current methods of CO and $CO_2$ conversion suffer from issues regarding low energy efficiency, hurdles to scalability and the requirement of energy intensive separations of mixed product streams.

SUMMARY

Described herein are devices and methods for the facile, efficient electrocatalytic conversion of carbon dioxide to high purity formic acid and distilled water. The described devices utilize perforated membranes to reduce energy requirements and extend electrochemical cell life by reducing damage caused by fluids being formed between internal ion exchange membranes.

In an aspect, provided is a device comprising: a) an anode; b) a cathode; and c) a cationic exchange membrane and an anionic exchange membrane positioned between the anode and cathode; wherein at least one of the cationic exchange membrane and the anionic exchange membrane is a perforated ion exchange membrane; wherein the device is an electrochemical cell for the conversion of carbon dioxide to organic compounds via electrolysis.

In another aspect, provided is a device comprising: a) an anode comprising a porous carbon electrode and an anode catalyst; b) a cathode comprising a porous carbon electrode and a cathode catalyst; c) a perforated cationic exchange membrane, positioned between the anode and the cathode; and d) an anionic exchange membrane positioned between the anode and the cathode; wherein the device is an electrochemical cell for the conversion of carbon dioxide to organic compounds via electrolysis.

The perforated ion exchange membrane may have various physical configurations and modifications to allow generated products to easily flow towards the anode without becoming trapped between the various other components of the electrochemical cell, for example, between the anion exchange membrane and the cation exchange membrane (which in this case, would be perforated). Examples of configurations included alternating lines (i.e., alternating parallel segments of membrane and void space, either vertically or horizontally), holes of void space, polka-dots (circles of membrane), crisscrossing lines or other geometric configurations. The perforated ion exchange membrane may have void space greater than or equal to 5%, 10%, 15%, 20%, 25%, 30%, 40% or 50% of the surface area of the membrane or the facing surface of the membrane. The perforated ion exchange membrane may have void space selected from the range of 0.1% to 50% of the surface area of the membrane or the facing surface of the membrane. The membrane may also be a catalyst coated membrane, for example, a membrane coated with Pt/HSC or Pt/V. Examples of useful membranes include Nafion or Nafion-based membranes and other polymers or fluorinated polymers.

The cathode may be a gas diffusion electrode and may comprise additional components including a cathode catalyst, a porous carbon electrode and additional membranes including anion exchange membranes. An example of an anion exchange membrane is a functionalized poly (aryl piperidinium) polymer membrane.

The anode may also comprise additional components including a porous carbon electrode and one or more additional catalyst layers.

In an aspect, provided is a method comprising: a) providing an electrochemical cell comprising: i) an anode; ii) a cathode; iii) a cationic exchange membrane and an anionic exchange membrane positioned between the anode and cathode; wherein at least one of the cationic exchange membrane and the anionic exchange membrane is a perforated ion exchange membrane; b) generating an electrical current between the anode and the cathode; c) flowing carbon dioxide gas to the cathode, thereby reacting the carbon dioxide gas and generating organic compounds.

The provided carbon dioxide gas may contain additional molecules or reactants, for example, potassium hydroxide and potassium bicarbonate.

The devices and methods provided herein may also be used for the facile conversion of carbon monoxide into organic compounds. Accordingly, the various references to $CO_2$ may be substituted with CO or a combination of both $CO_2$ and CO and provide the same or similar efficiencies and advantages. For clarity, any reference in this application to $CO_2$ can also be applied to CO.

REFERENCE NUMERALS

100 Electrochemical cell
110 Perforated ion exchange membrane
120 Anode
130 Cathode
140 Electrode (cathode)
150 Cathode catalyst
160 Anion exchange membrane
170 Anode catalyst
180 Electrode (anode)
190 Gas reactant flow chamber
200 Product flow chamber

BRIEF DESCRIPTION OF DRAWINGS

Some embodiments are illustrated in referenced figures of the drawings. It is intended that the embodiments and figures disclosed herein are to be considered illustrative rather than limiting.

FIG. 20A provides a schematic of the zero-gap MEA with CO2R at the cathode with the hydrogen oxidation reaction (HOR) or OER at the anode, using a single AEM membrane in the middle. FIG. 20B shows FE and cell voltage of the configuration of FIG. 20A with flowing 1 M KOH and OER at the anode. FIG. 20C shows FE and cell voltage of the system with $H_2$ and HOR at the anode. FIG. 20D provides a schematic of MEA with forward-bias BPM in the middle. FIG. 20E provides FE and cell voltage vs. time at 200 $mA/cm^2$ using the configuration in FIG. 20D. FIG. 20F is a cross-sectional image of the MEA with forward-bias BPM after short test.

FIG. 24A shows Cell voltage vs. time at 200 $mA/cm^2$. Inset figure is an optical microscope image of the EOT cross section of the MEA with perforated CEM. Scale bar: 300 μm. FIG. 24B provides FE and formic acid purity vs time at 200 $mA/cm^2$ using Pt/C anode.

FIG. 25A shows the first 3 hours of cell voltage vs. time at 200 $mA/cm^2$. FIG. 25B shows the first 3 hours of FE vs. time at 200 $mA/cm^2$.

FIG. 26A provides 3D structures of the catalyst layer by nano-Xray CT, and the catalyst particle distributions. Scale bar: 10 μm. FIG. 26B: Top 2: HAADF-STEM images of the BOT and EOT cathode catalyst layer. Scale bar: 1 μm. Bottom 2: Zoomed-in HAADF-STEM and EDX images of the EOT cathode catalyst layer. Scale bar: 100 nm.

DETAILED DESCRIPTION

Figure 1:
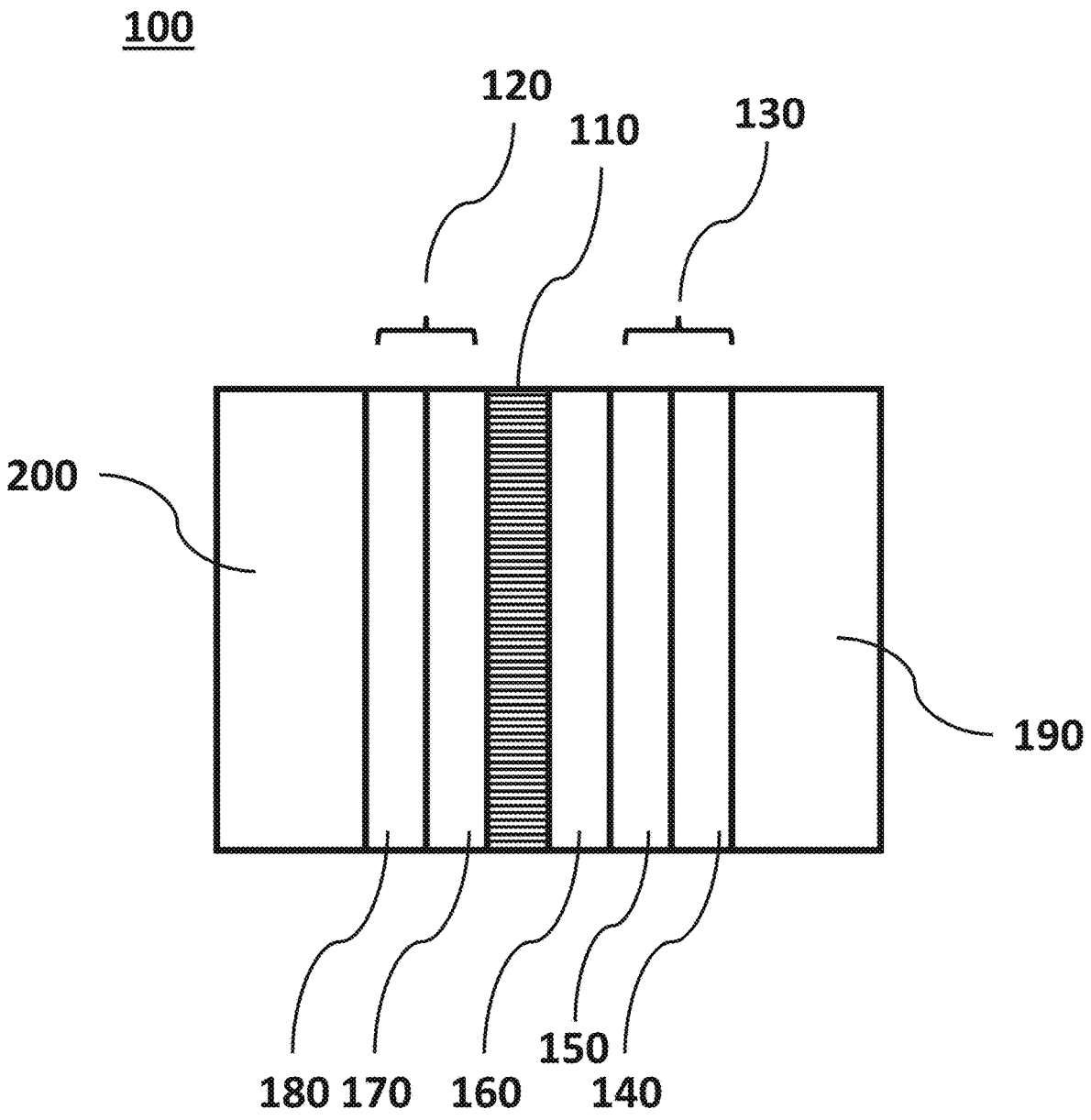
FIG. 1 provides an exemplary cross-sectional schematic of an electrochemical cell utilizing a perforated ion exchange membrane, as described herein.
Figure 2:
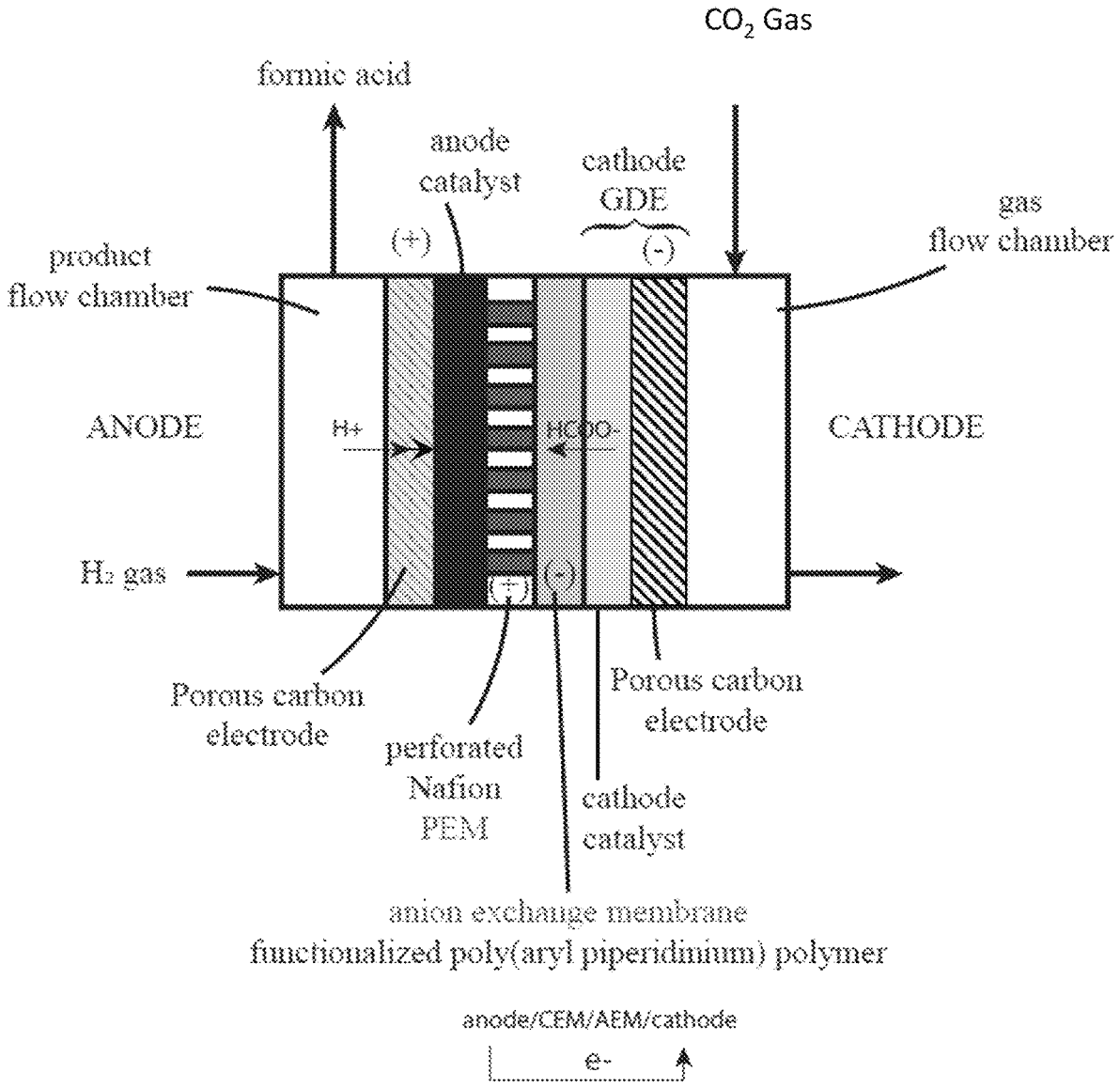
FIG. 2 provides a cross-sectional schematic of the described electrochemical cell with additional detail.
Figure 3:
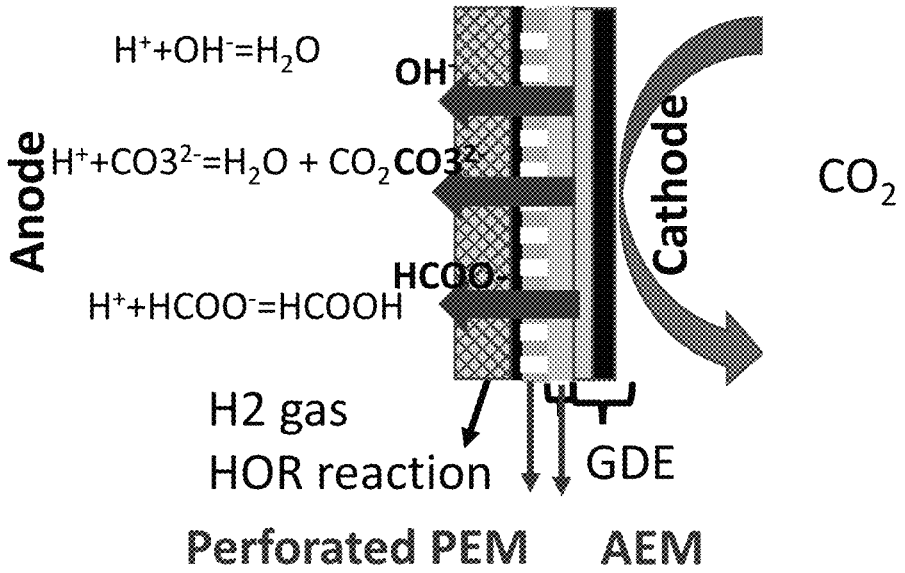
FIG. 3 illustrates a perforated ion exchange membrane system with additional compositional detail.
Figure 3:
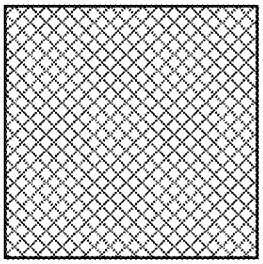
Figure 3:
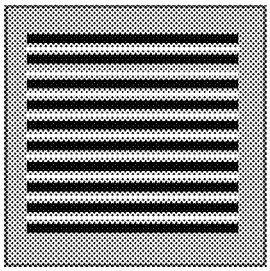
Figure 3:
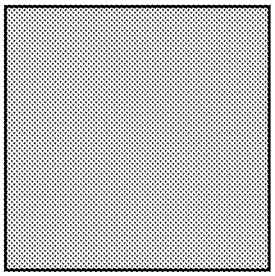
Figure 3:
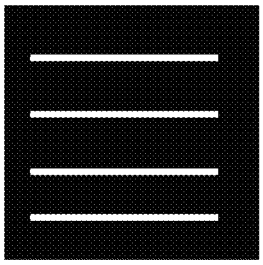

The embodiments described herein should not necessarily be construed as limited to addressing any of the particular problems or deficiencies discussed herein. References in the specification to "one embodiment", "an embodiment", "an example embodiment", "some embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

As used herein the term "substantially" is used to indicate that exact values are not necessarily attainable. By way of example, one of ordinary skill in the art will understand that in some chemical reactions 100% conversion of a reactant is possible, yet unlikely. Most of a reactant may be converted to a product and conversion of the reactant may asymptotically approach 100% conversion. So, although from a practical perspective 100% of the reactant is converted, from a technical perspective, a small and sometimes difficult to define amount remains. For this example of a chemical reactant, that amount may be relatively easily defined by the detection limits of the instrument used to test for it. However, in many cases, this amount may not be easily defined, hence the use of the term "substantially". In some embodiments of the present invention, the term "substantially" is defined as approaching a specific numeric value or target to within 20%, 15%, 10%, 5%, or within 1% of the value or target. In further embodiments of the present invention, the term "substantially" is defined as approaching a specific numeric value or target to within 1%, 0.9%, 0.8%, 0.7%, 0.6%, 0.5%, 0.4%, 0.3%, 0.2%, or 0.1% of the value or target.

As used herein, the term "about" is used to indicate that exact values are not necessarily attainable. Therefore, the term "about" is used to indicate this uncertainty limit. In some embodiments of the present invention, the term "about" is used to indicate an uncertainty limit of less than or equal to ±20%, ±15%, ±10%, ±5%, or ±1% of a specific numeric value or target. In some embodiments of the present invention, the term "about" is used to indicate an uncertainty limit of less than or equal to ±1%, ±0.9%, ±0.8%, ±0.7%, ±0.6%, ±0.5%, ±0.4%, ±0.3%, ±0.2%, or ±0.1% of a specific numeric value or target.

As used herein, the term "organic compounds" refers to reaction products of CO and $CO_2$ electrochemical reactions, including formic acid. The addition of additional reactants such as KOH and $KHCO_3$ and recycling or re-reacting product molecules allows for the production of larger organic compounds, for example, $C_2$-$C_{12}$ carboxylic acids, ethanol and ethylene, as examples. Organic compounds may also comprise CO and $CO_2$, regardless of whether a person having skill in the art would consider CO as "organic." For example CO may be converted in to $CO_2$ or $CO_2$ may be converted in to CO.

As used herein, the term "perforated ion exchange membrane" refers to a non-continuous polymer layer capable of exchanging ions, either cations or anions. While embodiments use a traditional membrane other forms of polymer thin film deposition (such as electrospinning) are also considered.

FIG. 1 provides a cross-sectional schematic of an electrochemical cell 100 utilizing a perforated ion exchange membrane 110 positioned in between the anode 120 and the cathode 130. In some embodiments, the perforated ion exchange membrane 110 is cationic and positioned proximate to the anode 120; however, the perforation may occur on the cathode side of the cell and utilize an anionic perforated membrane.

The anode 120 may include several features including an electrode 180 and a catalyst 170 or a catalytic layer. In some embodiments, a catalyst may be dispersed on the perforated (or unperforated) cationic membrane 110. The anion electrode 120 may be porous, including porous carbon.

The cathode 130 may also include several features including an electrode 140 and a catalyst 150 or a catalytic layer.

Additionally, in embodiments in which the perforated ionic membrane 110 is cationic and proximate to the anode side of the electrochemical cell 100, an additional perforated or unperforated anionic exchange membrane 160 can be included proximate to the cathode.

The electrochemical cell 100 also includes a gas flow chamber 190 for providing reactants to the cell 100. Example reactants include high purity carbon dioxide gas (e.g., greater than 90%), potassium hydroxide and potassium bicarbonate. The reactants are typically in the gas phase but may include liquids including dispersed liquid droplets. After conversion via electrolysis, products flow through the product flow chamber 200. Example products include formic acid and water in the liquid phase.

Figure 4:
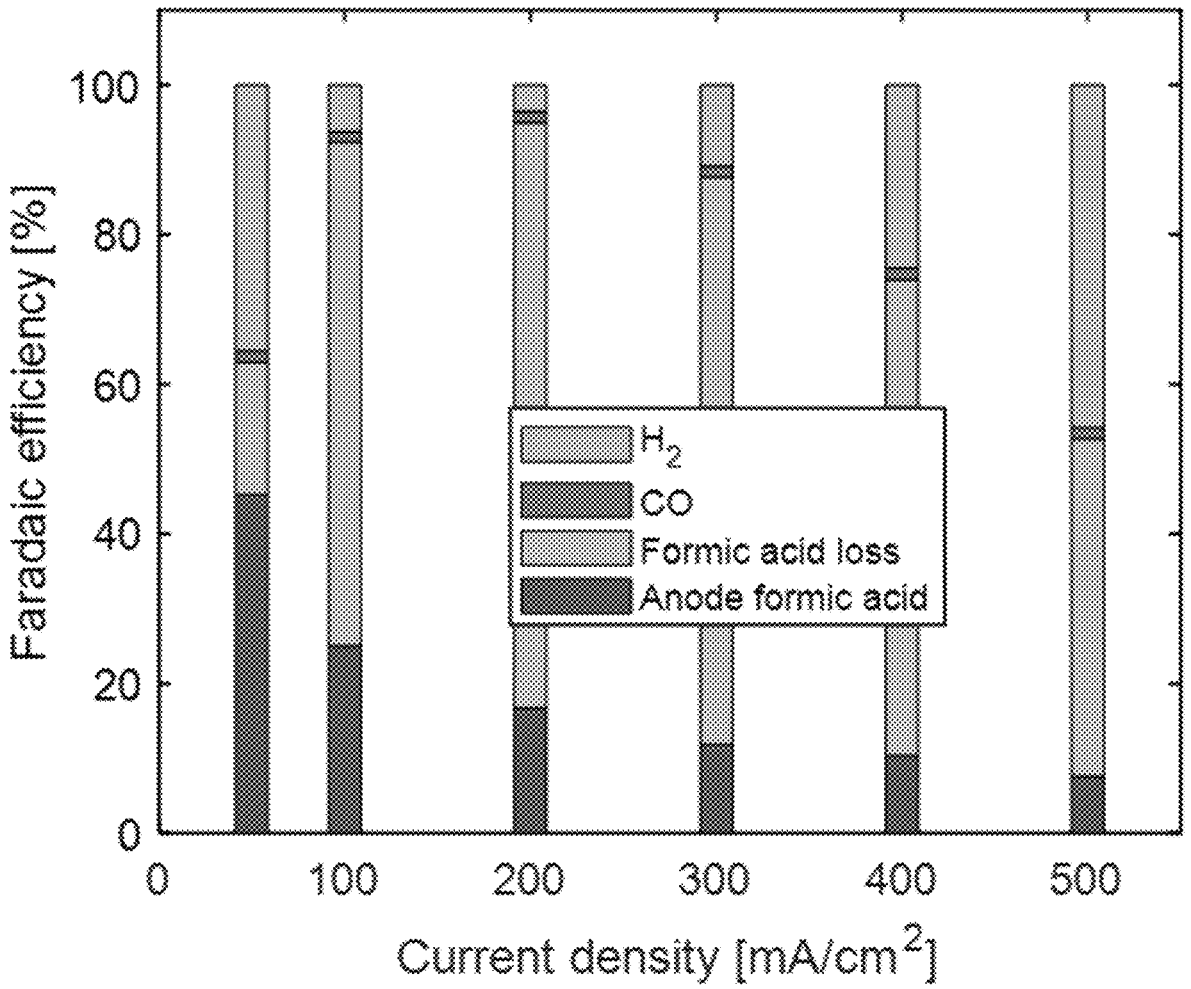
FIG. 4 shows Faradaic efficiency versus current density for an electrochemical cell generating formic acid without a cation exchange membrane, illustrating the high amount of formic acid loss due to oxidation of the product at the anode.
Figure 5:
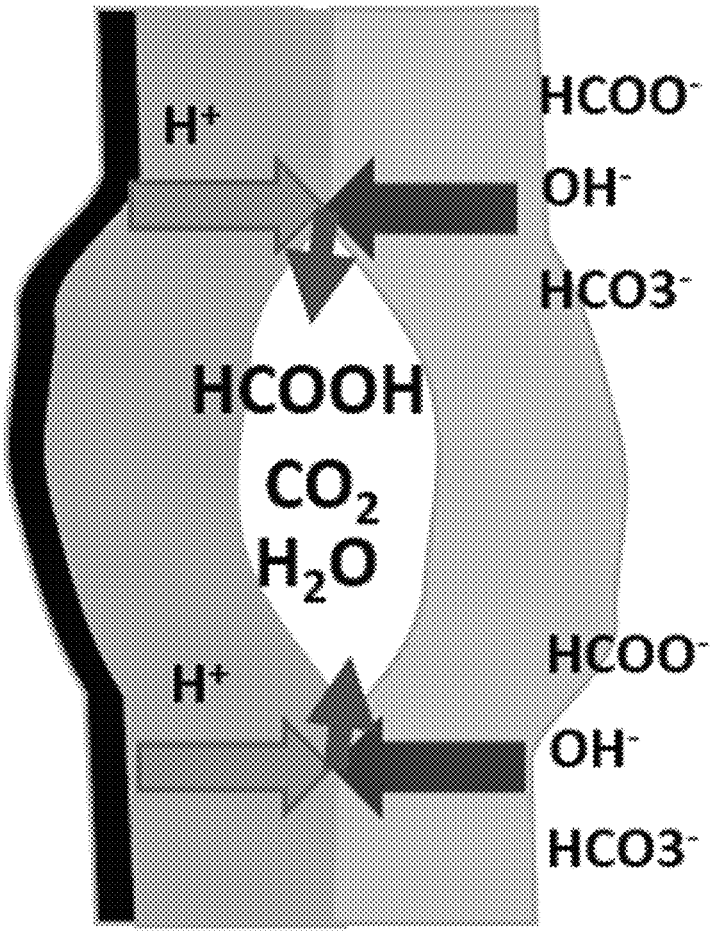
FIG. 5 illustrates the problems arising from using two unperforated membranes (one anionic, one cationic). Liquid products are trapped in between the two membranes, damaging the interface and reducing efficiency of the cell.
Figure 14:
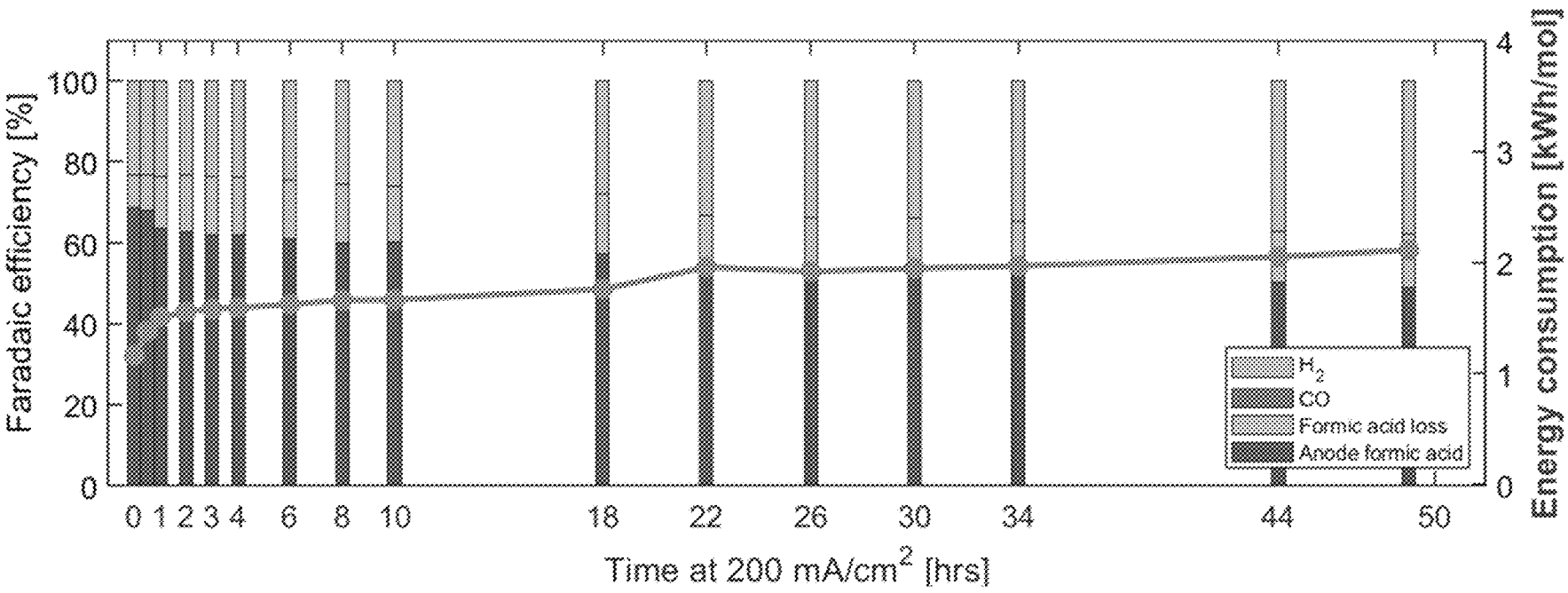
FIG. 14 provides both Faradaic efficiency and energy consumption over time for the configuration shown in FIG. 12.
Figure 15:
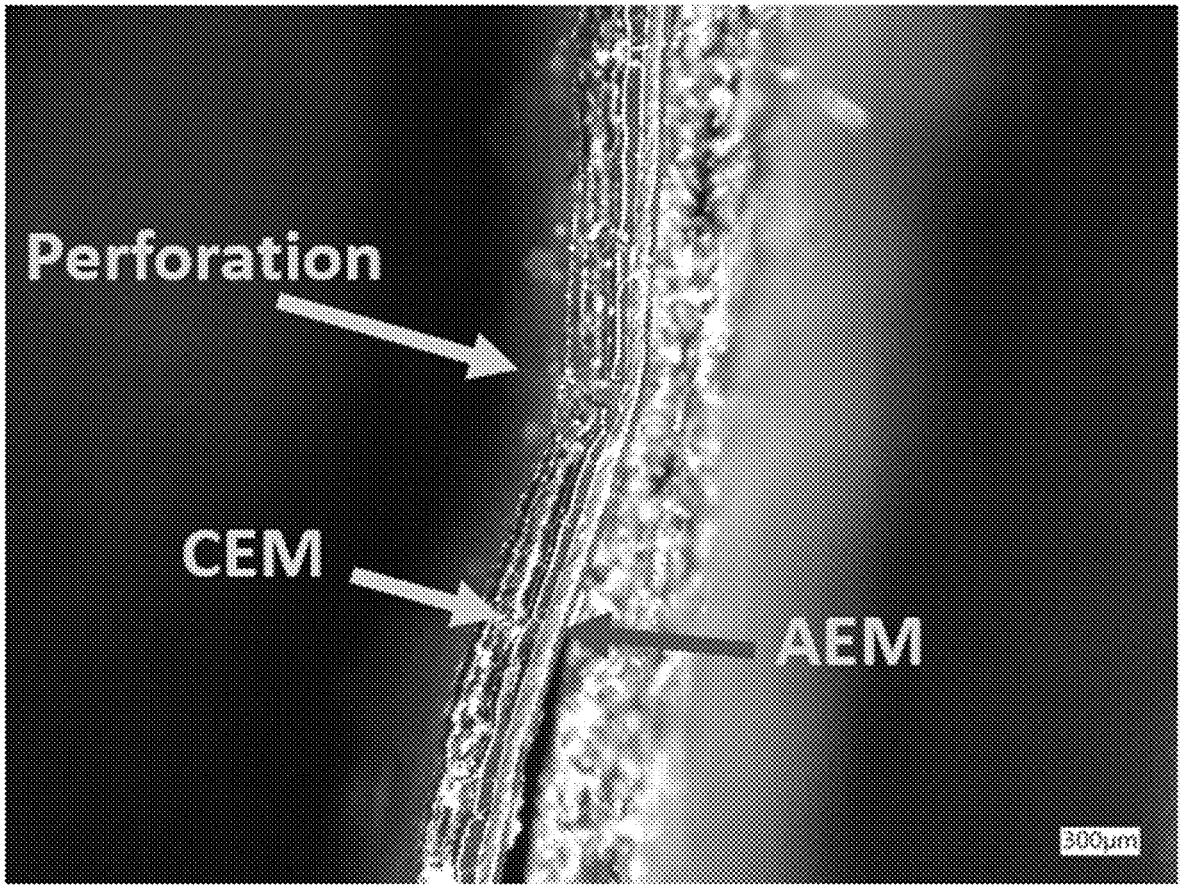
FIG. 15 is an image of the membrane interface of the perforated cationic membrane and anionic membrane of a cell that has been used to generate formic acid.
Figure 16:
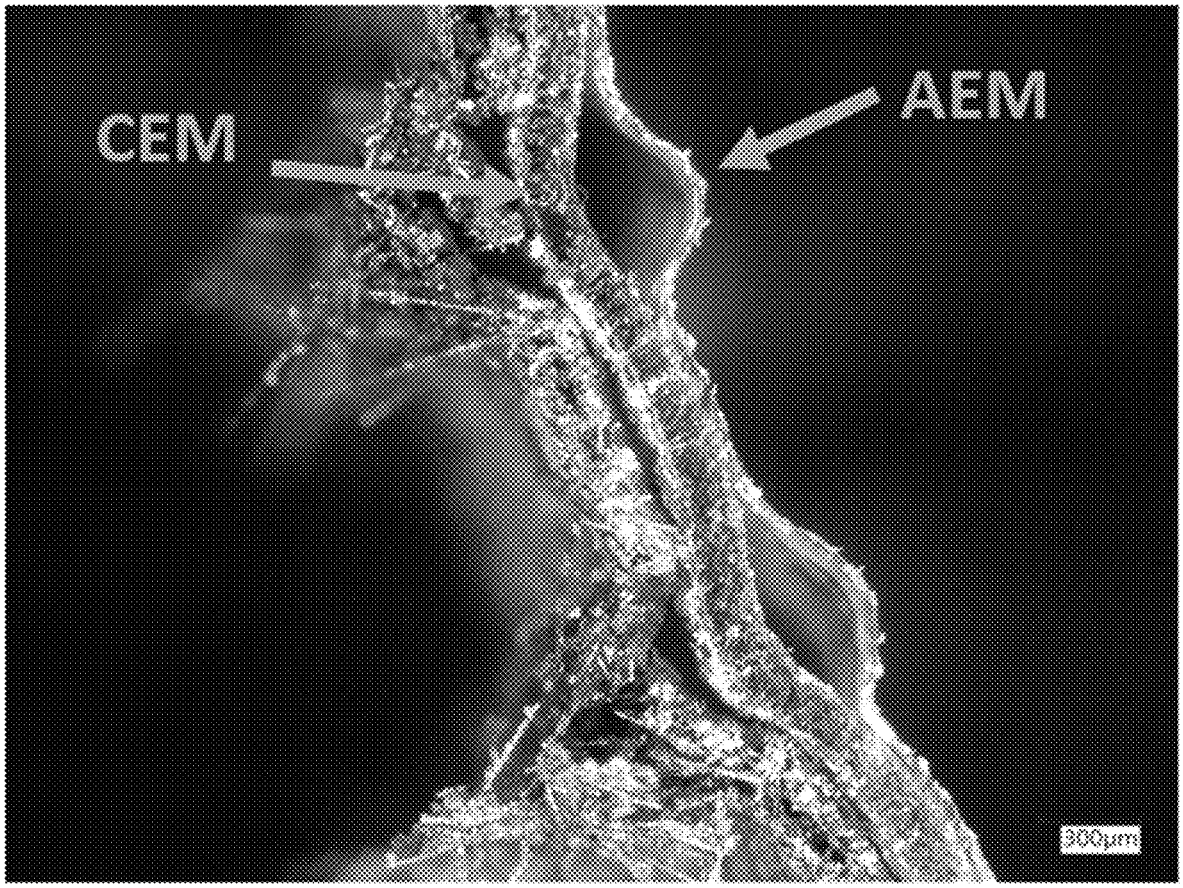
FIG. 16 is an image of the membrane interface of the unperforated cationic membrane and anionic membrane of a cell that has been used to generate formic acid. Clear ballooning or delamination between the two membranes can be seen.
Figure 17:
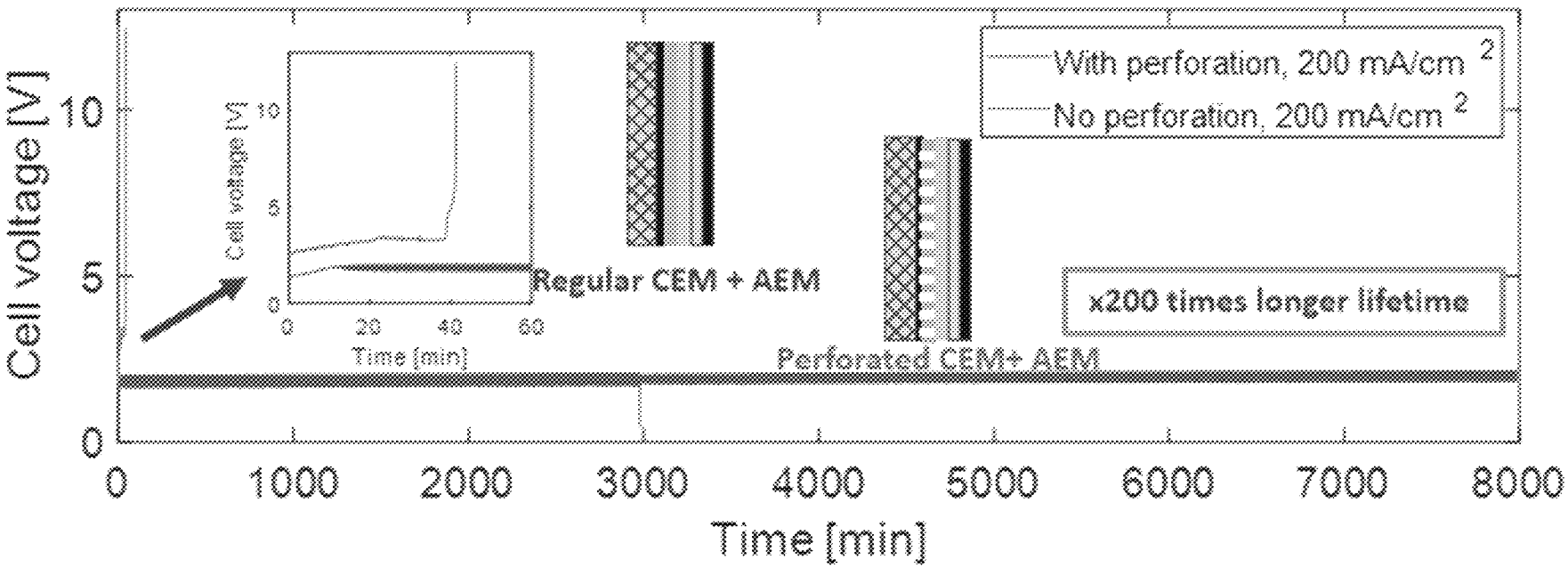
FIG. 17 provides a comparison cell voltage over time using a 200 $mA/cm^2$ applied current between an unperforated cationic exchange membrane and a perforated cationic exchange membrane, illustrating a 20× longer cell lifetime for the perforated membrane.
Figure 18:
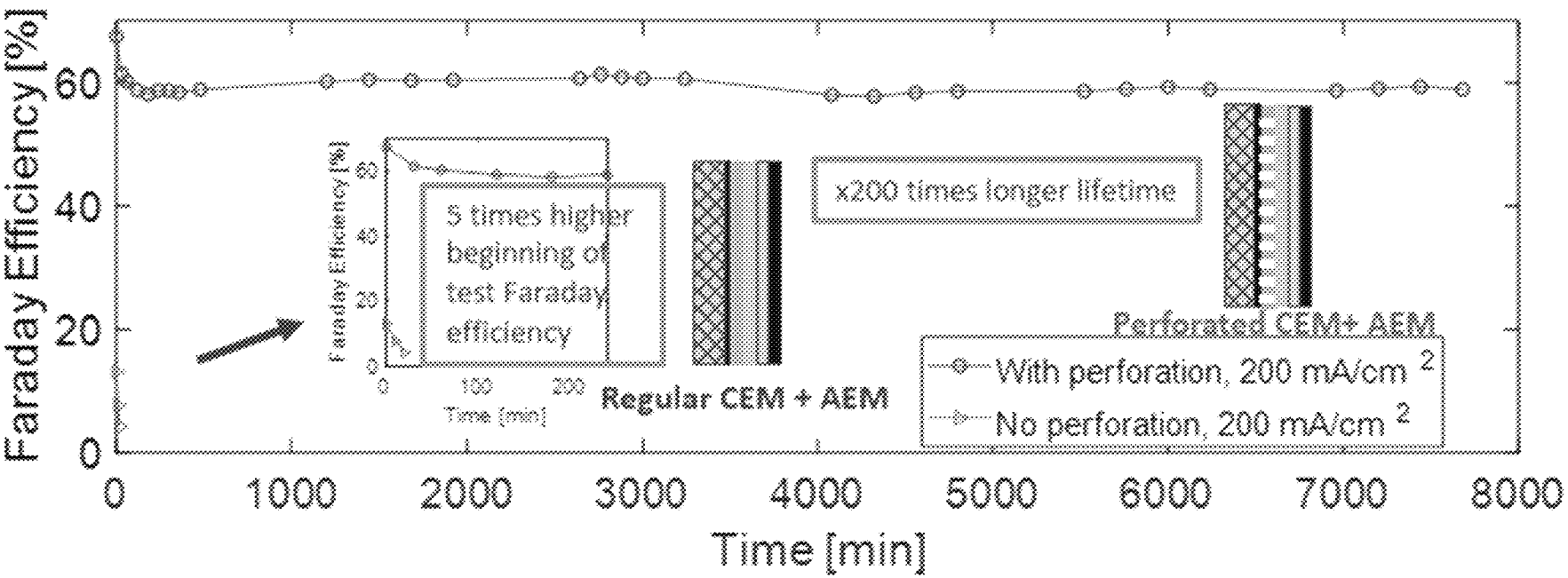
FIG. 18 provides a comparison of Faradaic efficiency of a cell with a perforated cationic membrane with a cell with an unperforated cationic membrane. That Faraday efficiency is initially 5× higher in the cell with the perforated membrane.

The benefit of utilizing two ionic exchange membranes (one anionic and one cationic) is illustrated by FIG. 4, which provides Faraday efficiency for a formic acid generating cell with a single membrane. Without the inclusion of the second, cationic exchange membrane a large amount of the formic acid product is oxidized, greatly reducing yields. However, the use of two full membranes causes products to build in between the two membranes causing ballooning or delamination at the interface between the membranes, as shown in FIG. 5. Evidence of this problem is shown in the images provided in FIGS. 14-15, where the used cell with a perforated cationic exchange membrane (FIG. 14) shows a smooth interface between the two membranes the unperforated membrane cell (FIG. 15) shows clear evidence of delamination and damage. By perforating one of the membranes, in this case the cationic exchange membrane on the anode side, cell life is increased by about two hundred times (FIG. 17) and initial Faraday efficiency is increased by more than five times (FIG. 18).

Figure 6:
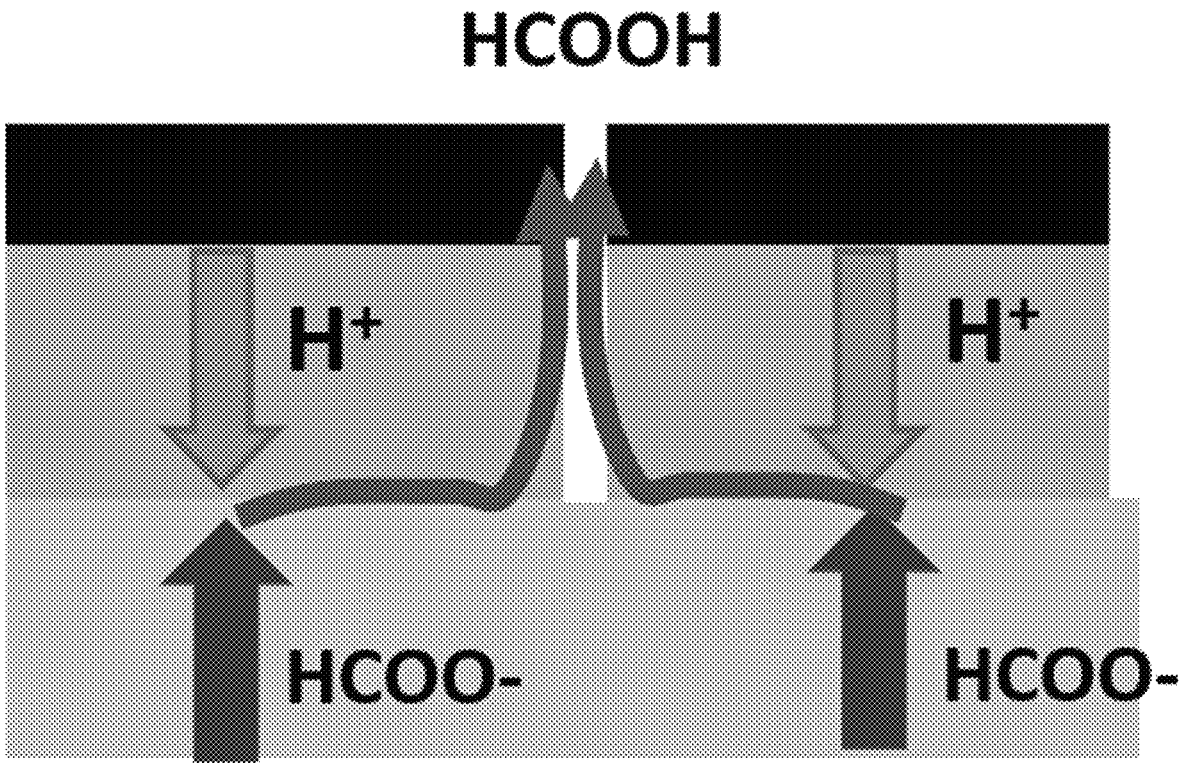
FIG. 6 provides an example of a perforated ion exchange membrane system.
Figure 7:
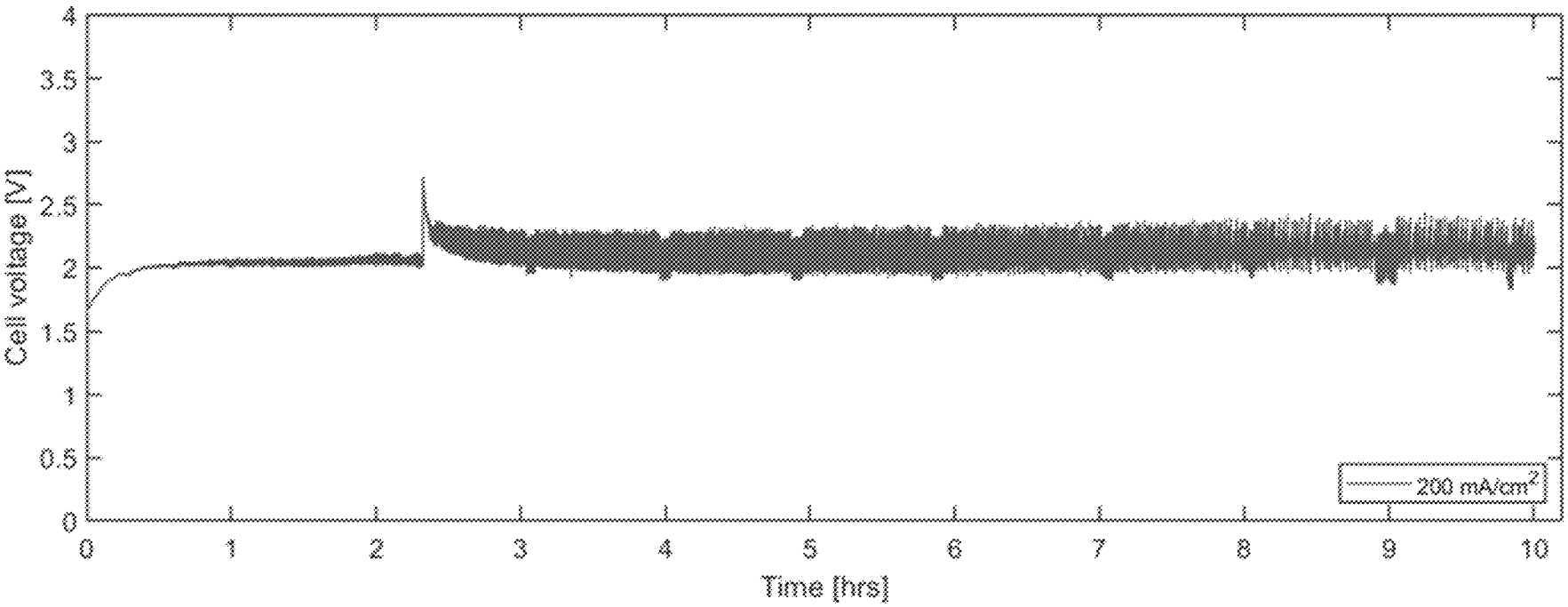
FIG. 7 provides cell voltage over time using a 200 $mA/cm^2$ applied current for the configuration shown in FIG. 6.
Figure 8:
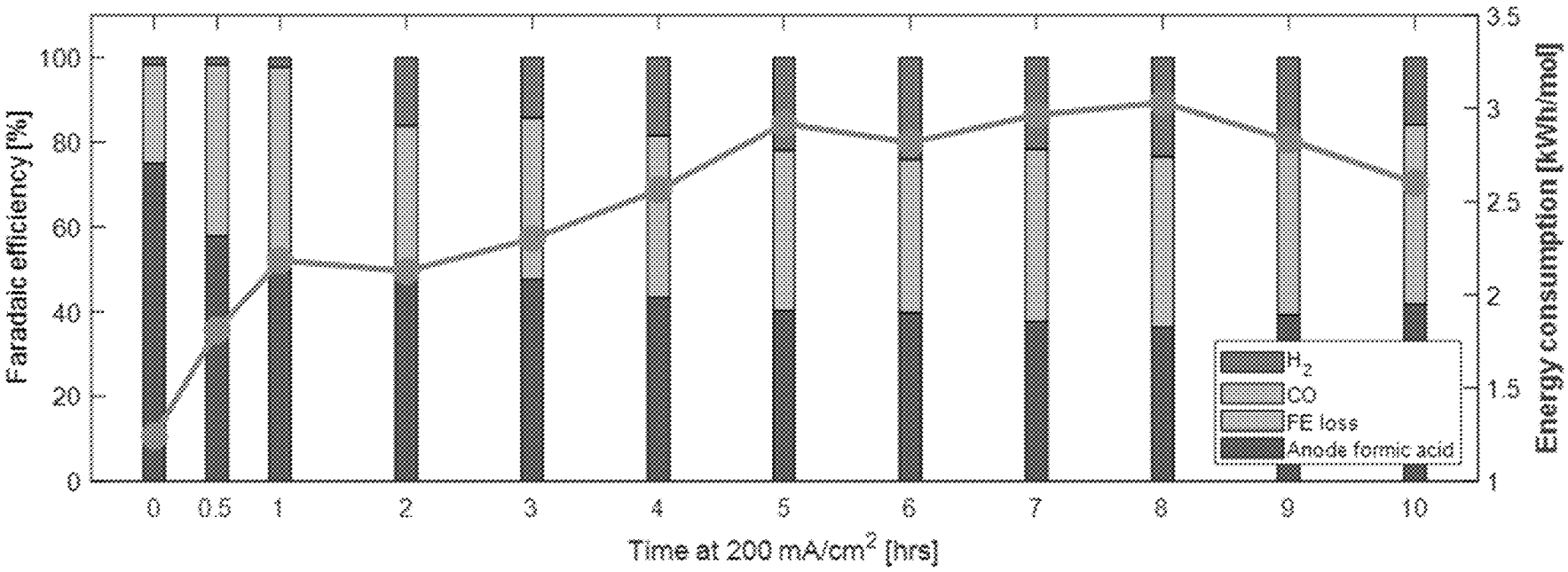
FIG. 8 provides both Faradaic efficiency and energy consumption over time for the configuration shown in FIG. 6.

FIG. 6 provides an example configuration of a perforated cationic exchange membrane, as described herein. The anode electrode is Pt/HSC 0.25 mg/cm$^2$ on 211 patterned membrane with Toray paper (no microporous layer (MPL)). The anode is being provided with 0.8 SLPM $H_2$ and 10 mL/min of deionized (DI) water. The anionic exchange membrane is 80 μm thick Versogen. The cathode is 39BB gas diffusion layer (GDL) with 2.5 mg/cm$^2$ $Bi_2O_3$ and an ionomer, I: catalyst 0.02. The cathode is provided with 2 SLPM $CO_2$ at 100% RH with premixed 2 mL/min 1M KOH. The cell temperature is 30° C. Experimental results for FIG. 6 are provided in FIGS. 7-8.

Figure 9:
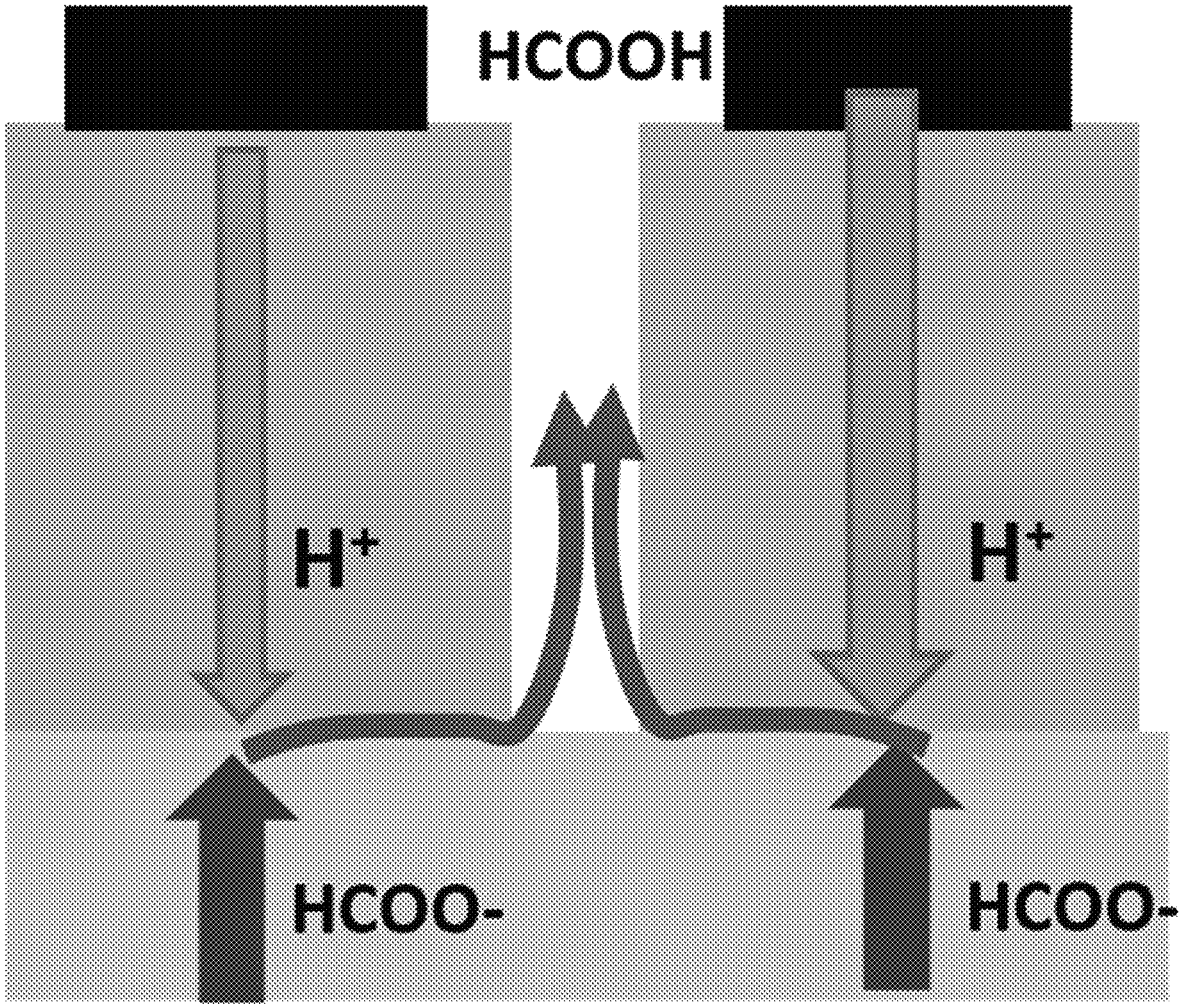
FIG. 9 provides an example of a perforated ion exchange membrane system.
Figure 10:
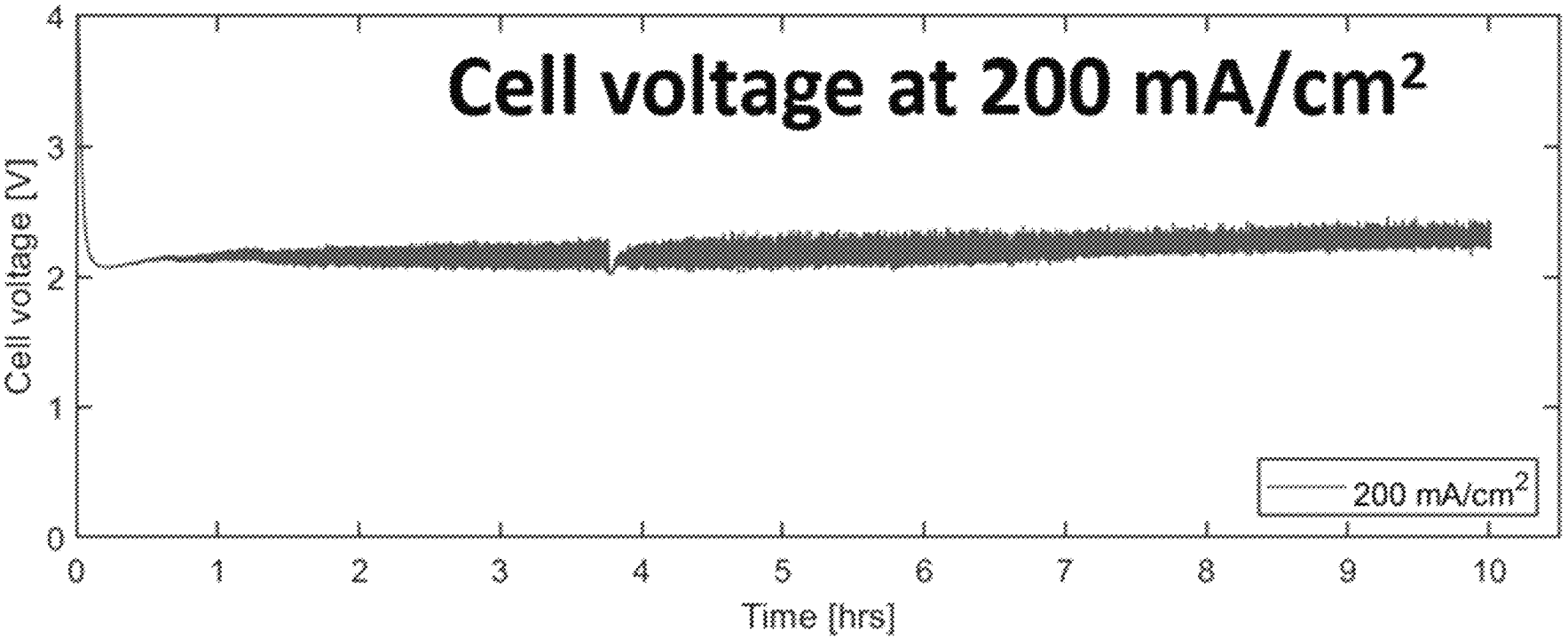
FIG. 10 provides cell voltage over time using a 200 $mA/cm^2$ applied current for the configuration show in FIG. 9.
Figure 11:
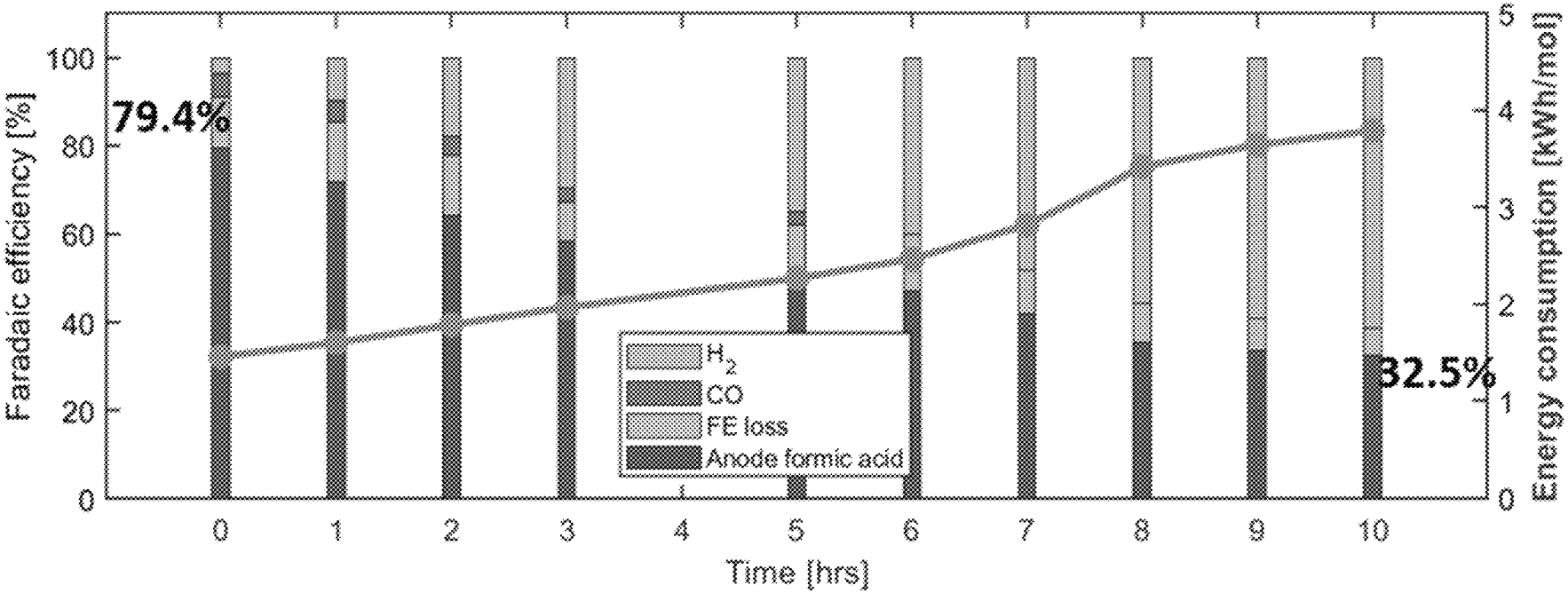
FIG. 11 provides both Faradaic efficiency and energy consumption over time for the configuration shown in FIG. 9.

FIG. 9 provides another example configuration of a perforated cationic exchange membrane, as described herein. The anode electrode is Pt/HSC 0.25 mg/cm$^2$ on 117 patterned membrane with Toray paper (no MPL). The anode is being provided with 0.8 SLPM $H_2$ and 10 mL/min of DI water. The anionic exchange membrane is 80 μm thick Versogen. The cathode is 39BB GDL with 2.5 mg/cm$^2$ $Bi_2O_3$ and an ionomer, I: catalyst 0.02. The cathode is provided with 2 SLPM $CO_2$ at 100% RH with premixed 5 mL/min 1M KOH. The cell temperature is 30° C. Experimental results for FIG. 9 are provided in FIGS. 10-11.

Figure 12:
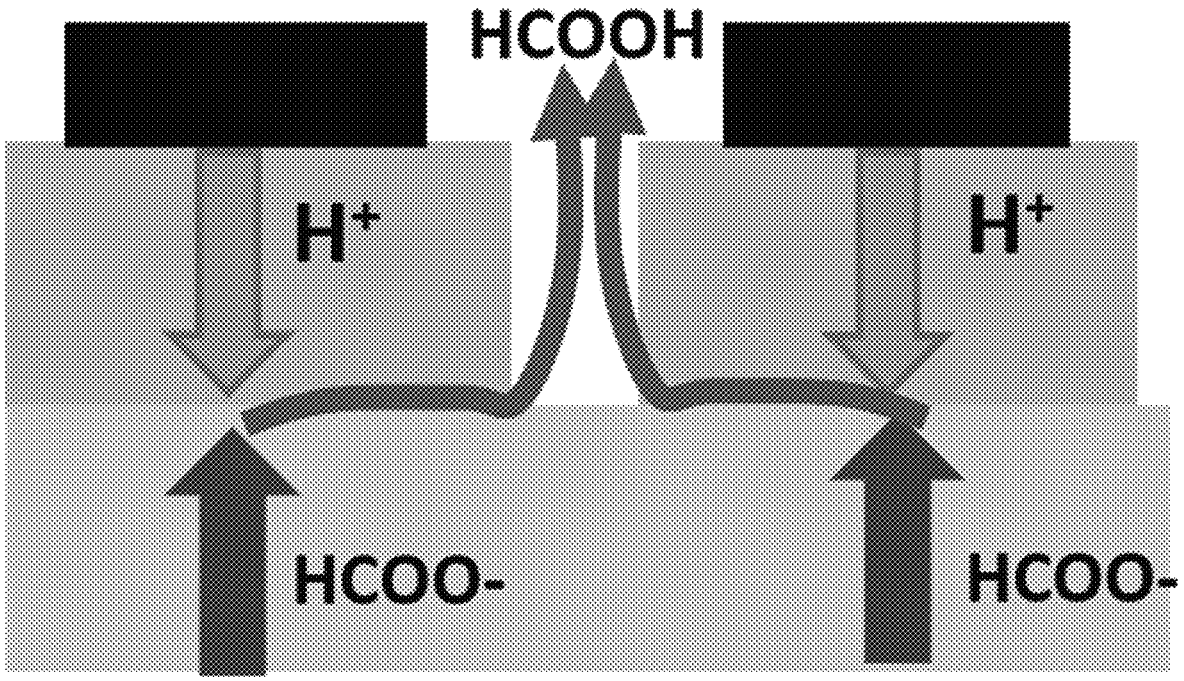
FIG. 12 provides an example of a perforated ion exchange membrane system.
Figure 13:
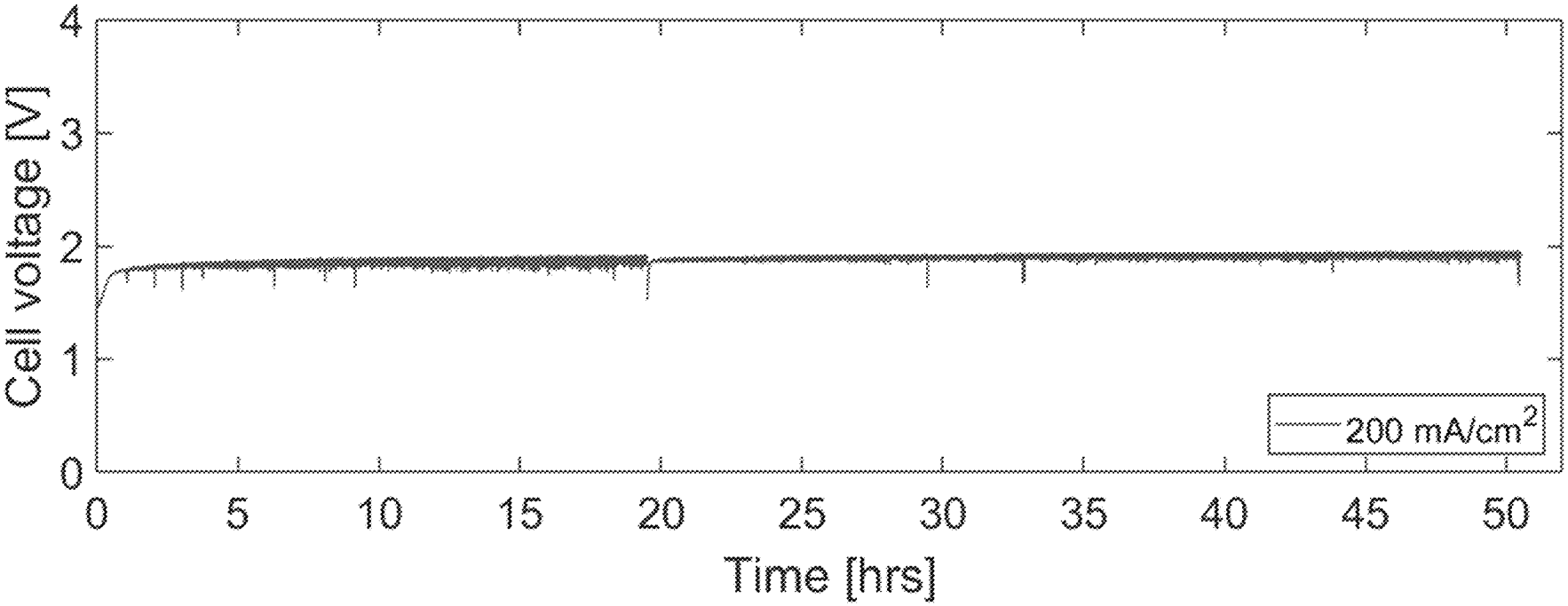
FIG. 13 provides cell voltage over time using a 200 $mA/cm^2$ applied current for the configuration show in FIG. 12.

FIG. 12 provides another example configuration of a perforated cationic exchange membrane, as described herein. The anode electrode is Pt/HSC 0.25 mg/cm$^2$ on NC700. The anode is being provided with 0.8 SLPM $H_2$ and 10 mL/min of DI water with a 10 g/hr DI water humidifier. The anionic exchange membrane is 80 μm thick Versogen. The cathode is 39BB GDL with 4 mg/cm$^2$ $Bi_2O_3$ and an ionomer, I: catalyst 0.02. The cathode is provided with 2 SLPM $CO_2$ at 100% RH with premixed 2 mL/min 1M KOH. The cell temperature is 60° C. Experimental results for FIG. 12 are provided in FIGS. 13-14.

Example 1—Scalable Membrane Electrode Assembly Architecture for Efficient Electrochemical Conversion of $CO_2$ to Formic Acid In this example, a zero-gap membrane electrode assembly (MEA) architecture was developed for the direct electrochemical synthesis of formic acid from carbon dioxide. The MEA contained a composite forward bias bipolar membrane with a perforated cation exchange membrane (PCEM) which allowed formic acid generated at the membrane interface to exit through the anode flow field at concentrations up to 0.25 M. As a result, this system is poised to leverage currently available materials and stack designs ubiquitous in fuel cell and $H_2$ electrolysis spaces, enabling a more rapid transition to scale and commercialization. The PCEM configuration achieved >80% Faradaic efficiency (FE) to formic acid at <2 V and 300 mA/cm$^2$ in a 25 cm$^2$ cell. More critically, a 55-hour stability test at 200 mA/cm$^2$ showed stable Faradaic efficiency and cell voltage.

The electrochemical reduction of carbon dioxide to formic acid using renewable electricity has been shown to reduce production cost compared to traditional fossil-based approaches by as much as 75%. Formic acid has a wide range of applications, from an effective and economical hydrogen-storage and transportation medium, to a feedstock for the chemical or biomass industry. Formic acid has even been identified as an input for subsequent conversion to sustainable jet fuel intermediates utilizing metabolic engineering. With momentum building for a formic acid economy, multiple research efforts have focused on the optimization of catalyst selectivity. However, the majority of efforts remain on small-scale H-cell or liquid flow cells operating at low current densities (<50 mA/cm$^2$). To reduce cost, enable commercialization, and increase subsequent market penetration, electrochemical carbon dioxide reduction (CO2R) must be performed at high current densities (≥200 mA/cm$^2$) and Faradaic efficiency (FE) while maximizing the utilization of materials and stack components from fuel cell and water electrolysis technology that enable CO2R devices to leverage economies of scale. Furthermore, to enhance the production utility and avoid additional downstream processing, formic acid should be targeted as an end product instead of formate salt.

Figure 19A:
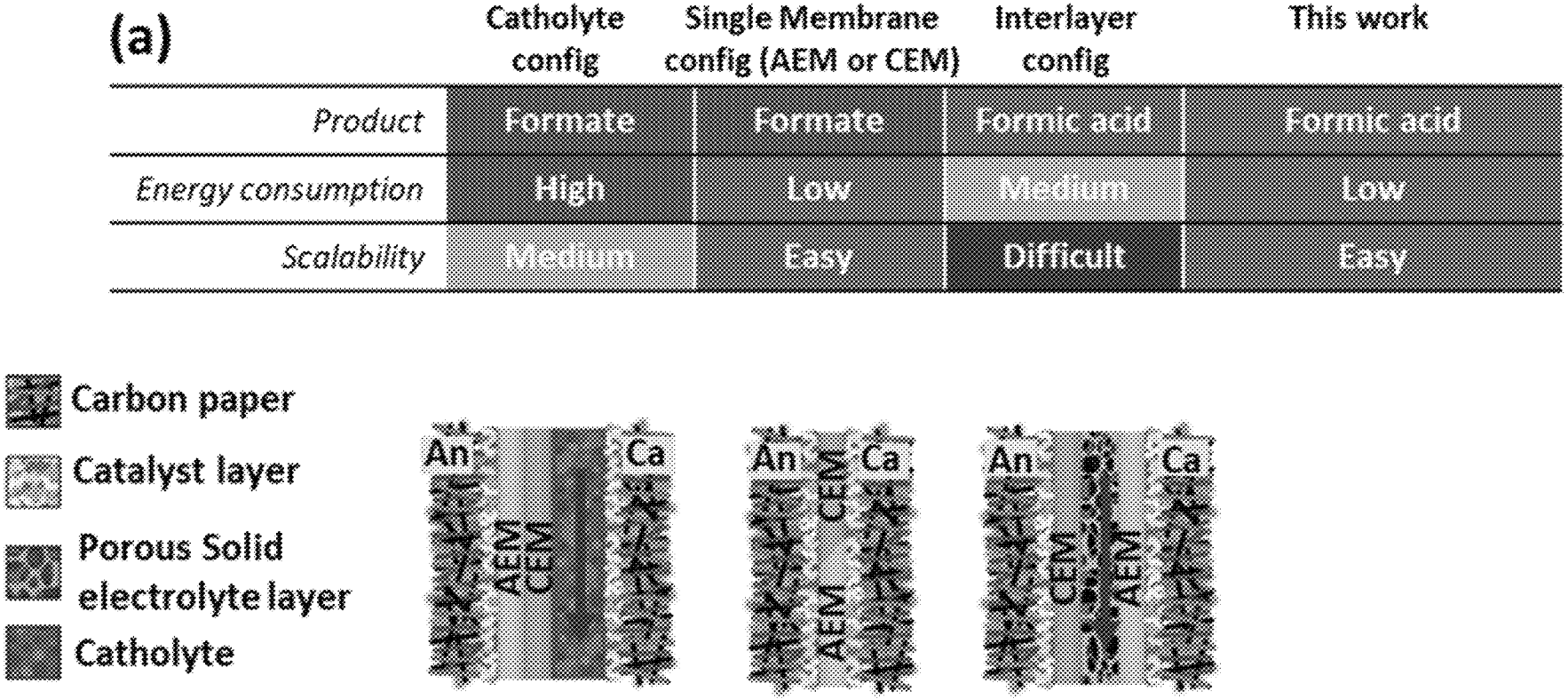
FIG. 19A provides a comparison of the three most prominent device configurations for CO2R to formate/formic acid, along with the architecture described herein (Shown if FIG. 19C).

Along these lines, recent efforts have been made to develop industrially relevant gas diffusion electrode (GDE) based CO2R to formate/formic acid devices. These device configurations can be categorized into three main groups: 1. Flowing catholyte, 2. Single membrane (either cation exchange membrane (CEM) or anion exchange membrane (AEM)), and 3. Interlayer configurations. Simplified cross sections for these configurations are shown in FIG. 19A. For catholyte configurations, an electrolyte chamber is created between the membrane and the cathode GDE. The flowing catholyte serves to provide ionic access to the cathode catalyst layer, though its necessity to control formate selectivity has been debated. Nevertheless, recently, researchers achieved up to 90% FE to formate at 500 mA/cm$^2$ using a carbon supported $SnO_2$ cathode with 1.27 mm thick catholyte layer. The thick catholyte layer, coupled with a reverse-bias bipolar membrane (BPM) to limit ion crossover, resulted in an operating voltage of 6 V and a 15% energy efficiency. To improve energy efficiency, a single CEM configuration was implemented, achieving 93.3% FE at a partial current density of 51.7 mA/cm$^2$. Both approaches yielded formate as opposed to the preferred product, formic acid. Additional processing requirements aside, in a CEM configurations, formate salt (e.g., KCOOH) frequently accumulates in the GDE and flow field resulting in transport limitations and eventual cell failure.

To combat the formation of formate salt, the use of a solid electrolyte interlayer between the CEM and AEM to promote the formation of formic acid, which achieved 91.3% FE at 200 mA/cm$^2$ in a 5 cm$^2$ cell, yielding a 6.35 wt. % formic acid solution. In a separate experiment, a similar configuration achieved 83% carbon dioxide ($CO_2$) to formic acid FE at 200 mA/cm$^2$, examining the durability of the system over 100 hrs. While small scale results are promising, the added cost of the porous ion-exchange resin, additional complexity in stack design, and the pressure required to push formic acid through the porous interlayer make interlayer configurations challenging to scale to larger systems (e.g., 1000 cm$^2$).

Figure 19B:
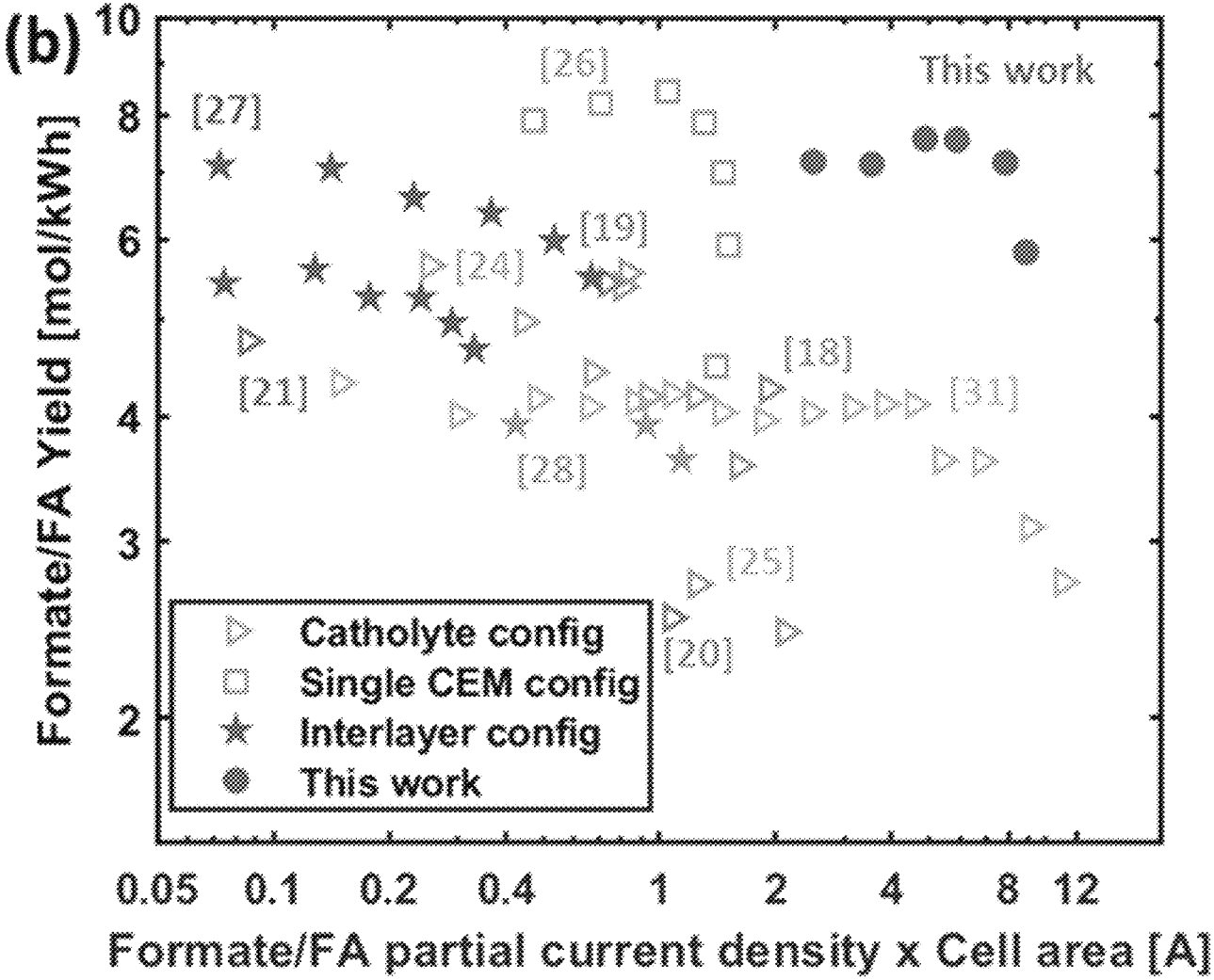
FIG. 19B provides a comparison of total current and formate/formic acid yield for catholyte configuration, interlayer configuration, and single CEM configuration from previous works. Hollow markers represent the production of formate salt solution, while solid markers indicate the production of formic acid.

To help visualize the net impact of the various designs, we tabulated formate/formic acid production per kWh for all the previously referenced systems and plotted them in FIG. 19B. Here, it is evident that any system containing a catholyte or interlayer reaches a maximum in performance at low current densities with performance decreasing at higher current densities. Additionally, while energy efficient CEM configurations yield the highest production of $mol_{formic\ acid}$/kWh, salt accumulation results in a rapid decrease in performance at high current densities.

Figure 19C:
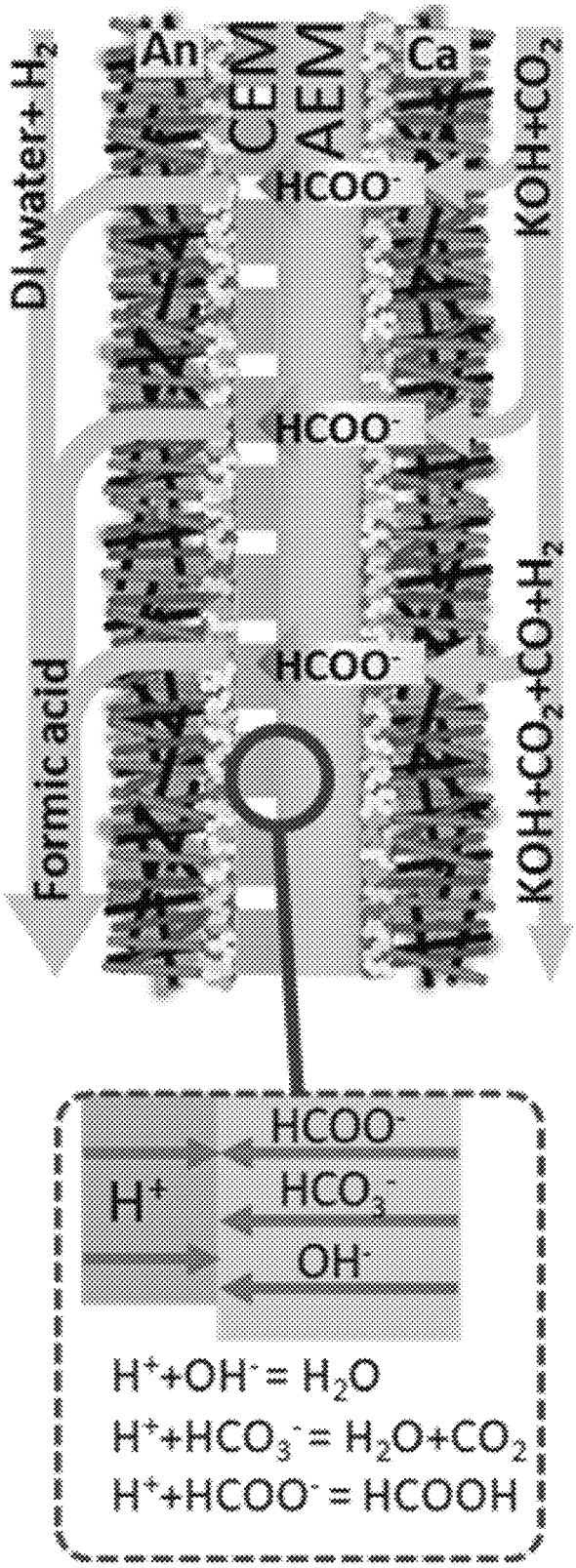
FIG. 19C shows the structure of zero-gap MEA configuration using composite bipolar membrane with perforated cation exchange layer operating in forward-bias mode.

To mitigate the previously discussed failure modes, we developed a membrane electrode assembly (MEA) containing a composite forward bias BPM with a perforated cation exchange membrane (PCEM). This architecture is detailed in FIG. 19C. The anode is supplied with hydrogen ($H_2$), and protons are generated by hydrogen oxidation reaction (HOR). The introduction of a PCEM layer in a BPM system enables formate ions generated at the cathode to traverse the AEM, combine with protons to form formic acid at the BPM interface and interstitial CEM pores, subsequently departing through the anode GDE and flow field. Using this configuration, we achieve >80% FE to formic acid at <2 V and 300 mA/cm$^2$ for a 25 cm$^2$ cell. Most critically, this design leverages commercially available components and device architectures used for fuel cell and water electrolyzer stacks, enabling a more rapid transition to scale.

Discussion

Figure 20A:
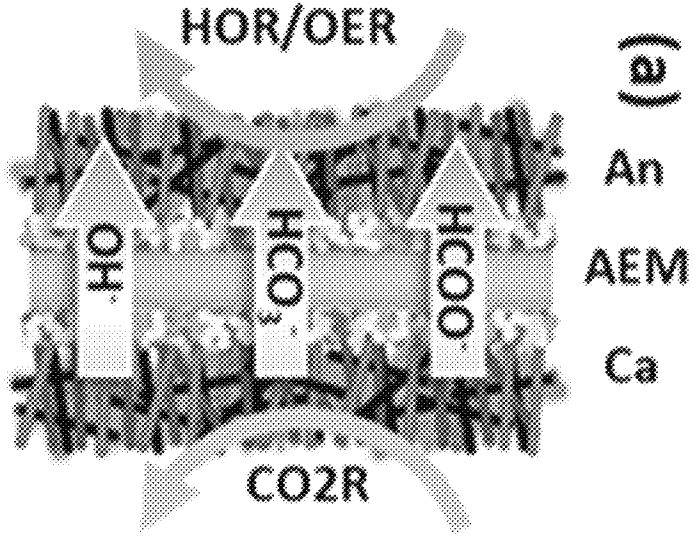
FIGS. 20A-20F illustrate the performance of two different zero-gap MEA configurations.
Figure 20B:
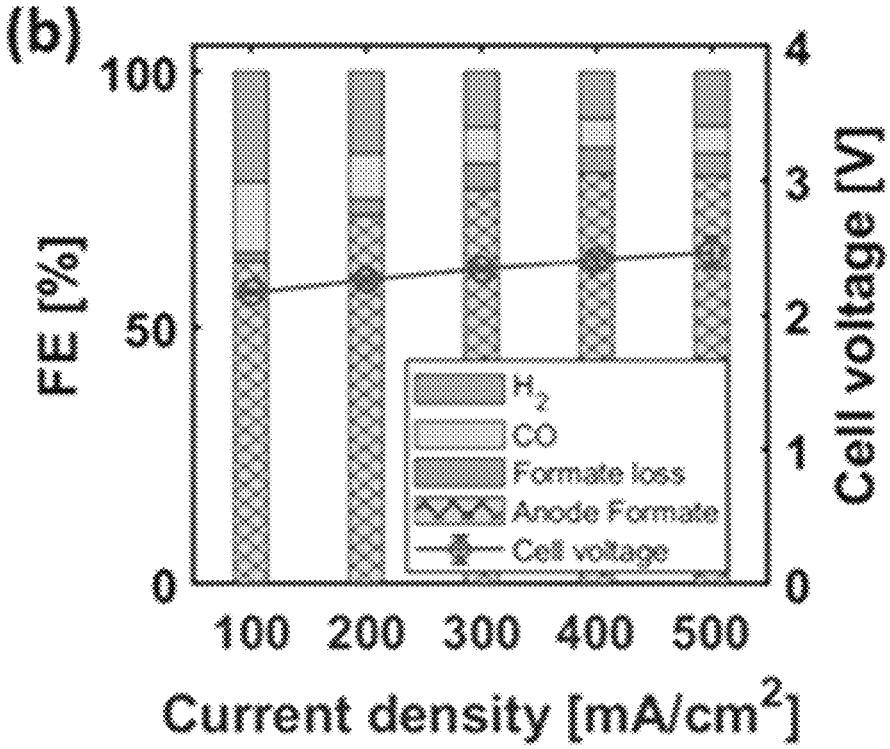
Figure 20C:
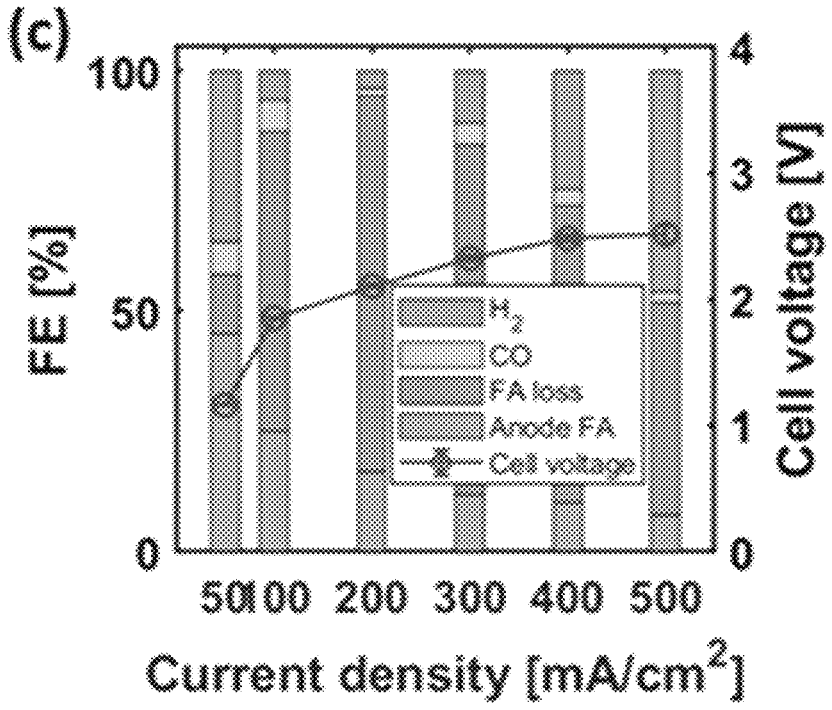
Figure 21A:
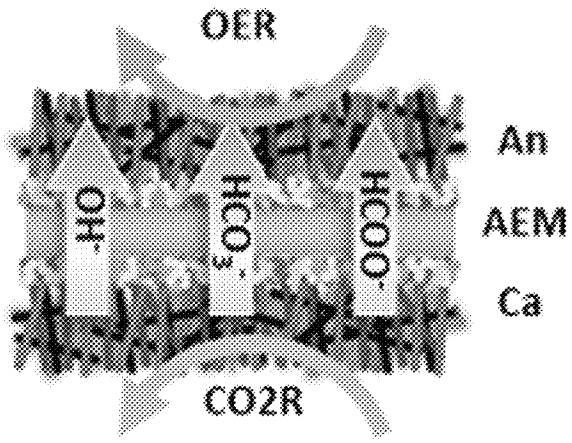
FIG. 21A provides a schematic of the zero-gap MEA with CO2R at the cathode with the Oxygen evolution reaction at the anode.
Figure 21B:
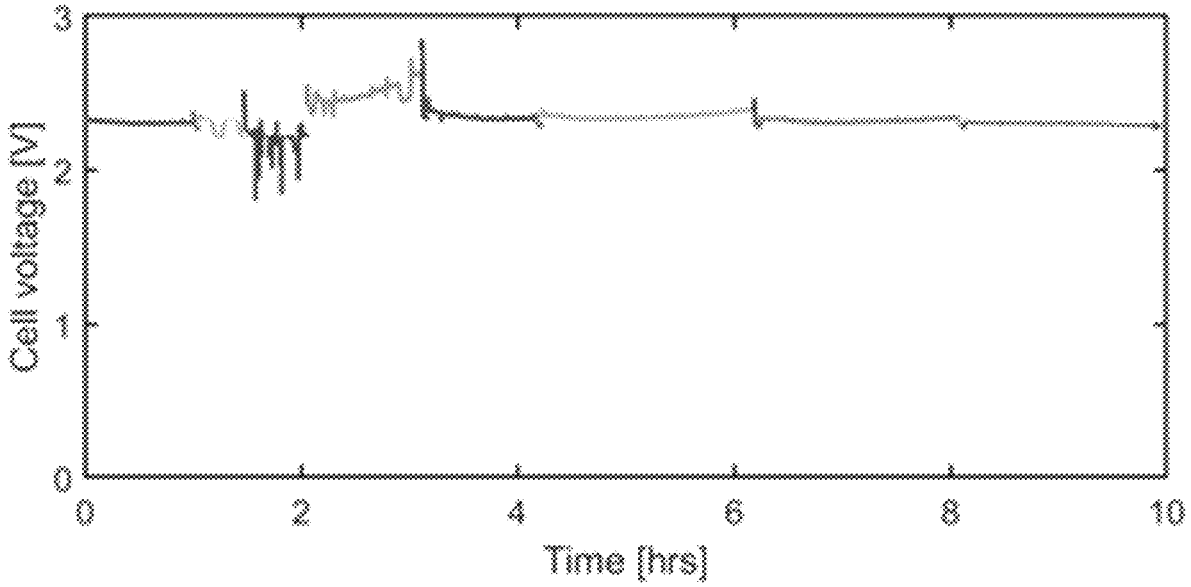
FIG. 21B provides cell voltage and FIG. 21C provides FE vs. time at 200 $mA/cm^2$ with 1M KOH used at the anode.
Figure 21C:
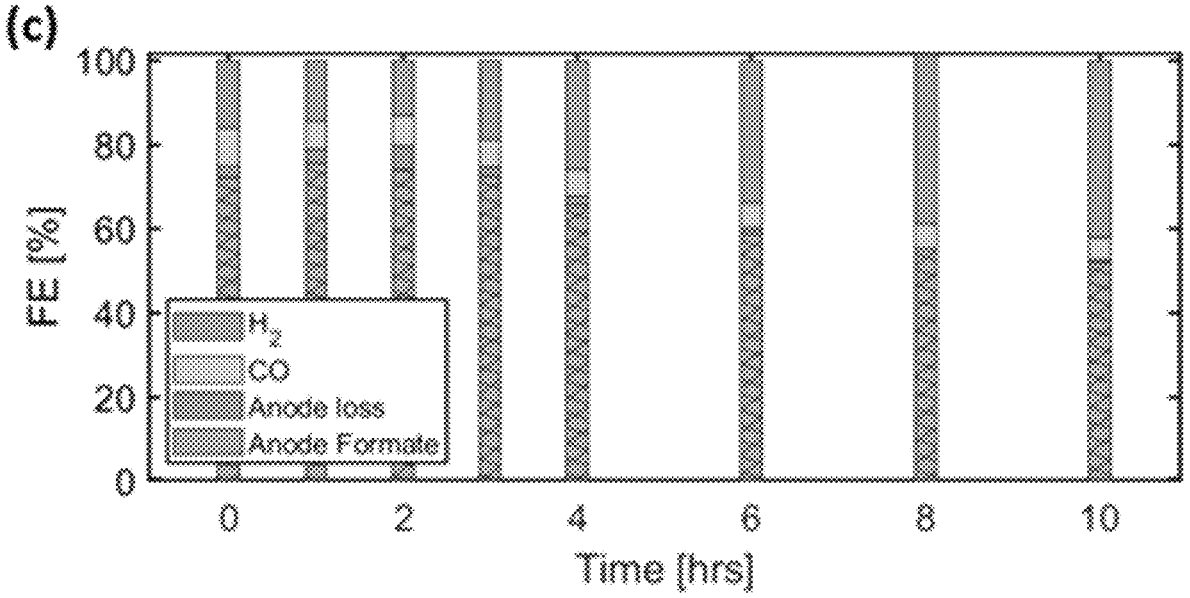
FIG. 21D shows FE and cell voltage at different current densities when 0.1 M KOH is used at the anode.
Figure 21D:
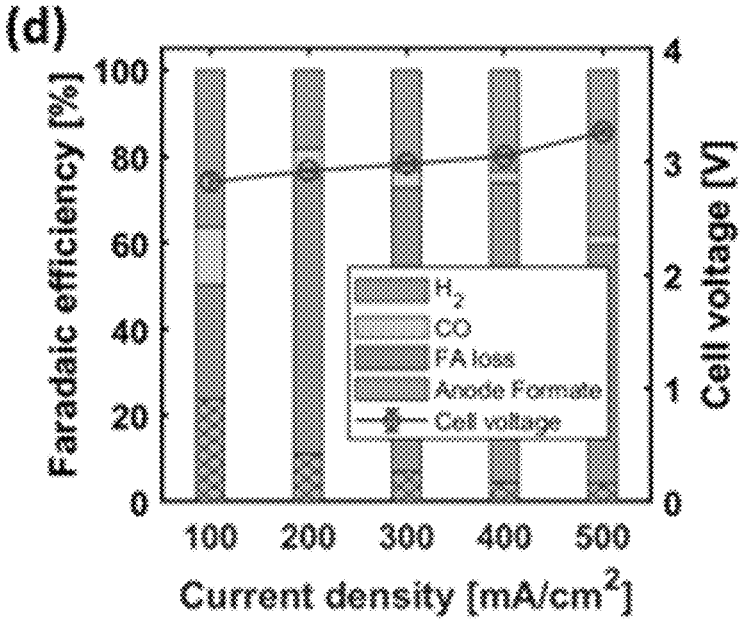

To suppress $H_2$ evolution, a plethora of $CO_2$ reduction efforts have utilized MEA configurations and AEM membranes, coupled with high molarity electrolytes (e.g., 1-10 M KOH) to create alkaline conditions on the cathode (as shown in FIG. 20A). In these configurations, formate ions generated at the cathode traverse the membrane as negatively charged species where they then form KCOOH and are ushered out of the system through the anode KOH stream. While formate FE and cell voltage are initially favorable, FIG. 20B, stability tests resulted in an approximately 30% FE reduction over just 10 hrs (FIGS. 21A-21C). It should be noted that the use of 1 M KOH anolyte is critical to both minimize anode overpotential in basic oxygen evolution reaction (OER) systems and enable ionic accessibility within the cathode catalyst layer. High KOH concentrations can, however, introduce carbonate/bi-carbonate salt formation at the cathode and result in potassium formate production as opposed to the preferred product, formic acid. When anolyte concentration is reduced to 0.1 M KOH, both cell voltage and formate oxidation (formate loss) increase (FIG. 21D), illustrating the zero-sum tradeoff.

Figure 20D:
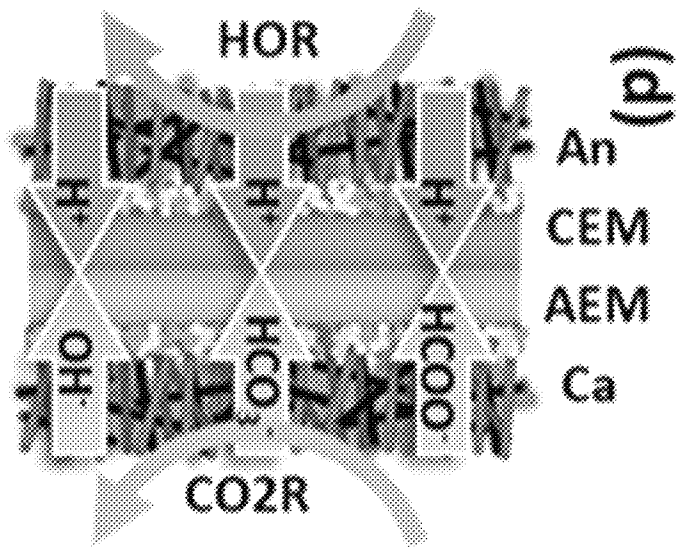
Figure 20E:
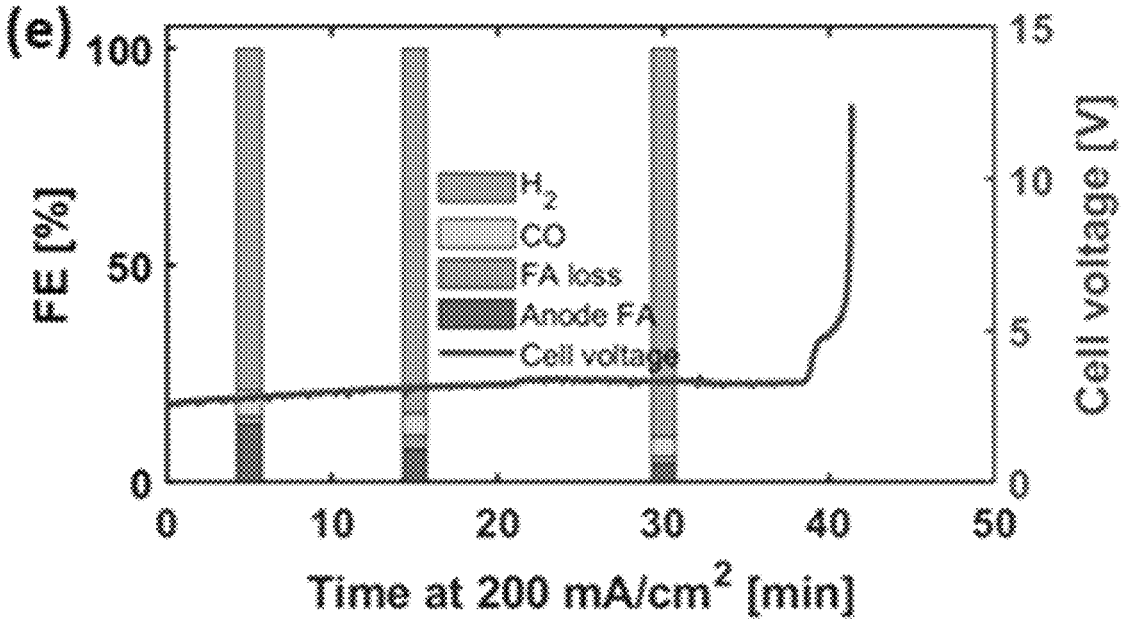
Figure 20F:
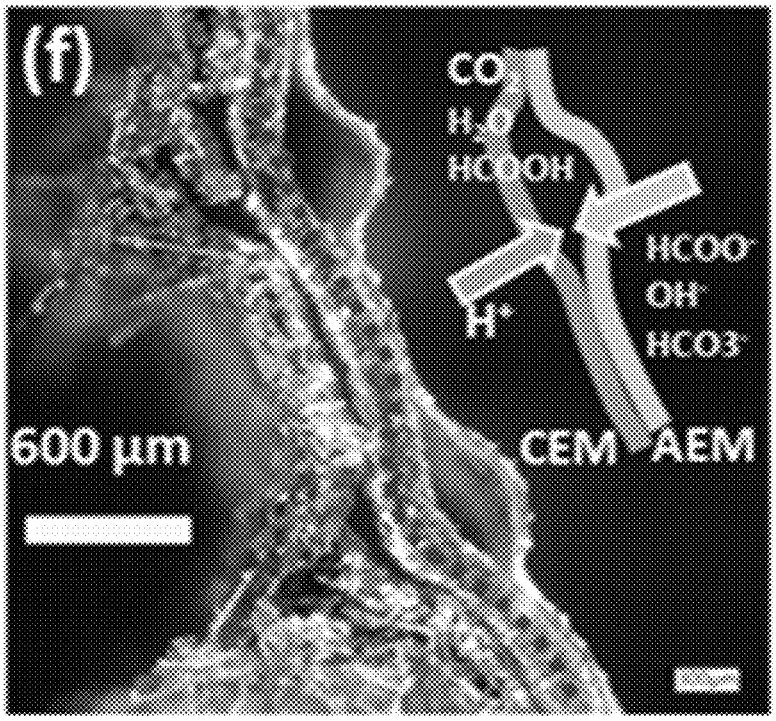

To target formic acid generation, $H_2$ was supplied at the anode to a carbon supported Pt (Pt/C) catalyst. While this AEM configuration produced lower cell voltage and the FE for CO and $H_2$ remained low (<20% total FE from 100-300 mA/cm$^2$), there was significant oxidation of formic acid at the anode. In fact, from 100-400 mA/cm$^2$>60% of the total product FE was unaccounted for due to formic acid oxidation. Along similar lines, forward bias BPMs that generate protons at the anode have been previously examined to enable formic acid production (FIG. 20D). It is worth revisiting the performance and failure modes for BPM configurations for such systems absent more costly and complex interlayer configurations that would prove difficult to scale. As shown on FIG. 20E, the BPM configuration cell failed after 40 mins at 200 mA/cm$^2$, accompanied by a voltage surge to over 5 V. Significant delamination at the CEM/AEM interface was observed after the test. In addition to formate, anions such as carbonate, bicarbonate, and hydroxide can also transport through the AEM membrane, reacting with protons at the CEM/AEM interface, forming $CO_2$ gas and liquid water, which can lead to BPM delamination (FIG. 20F) and ultimately cell failure.

Figure 22A:
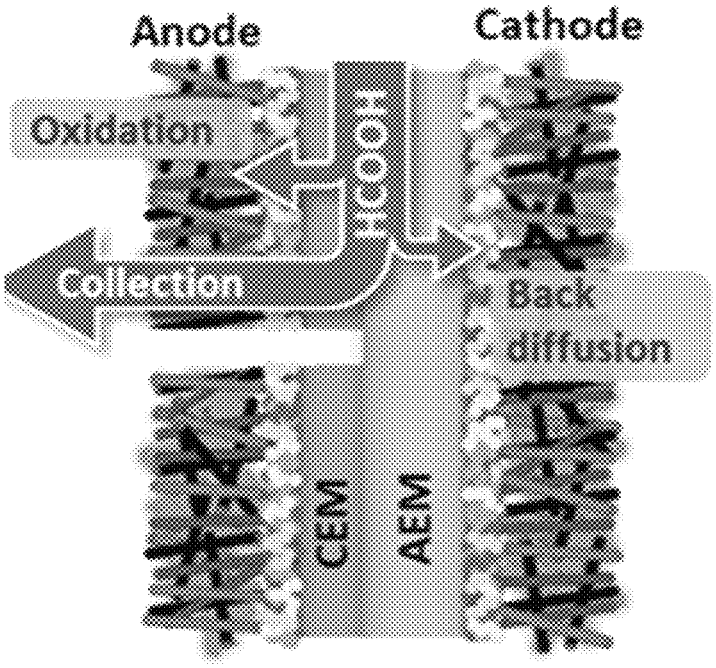
FIG. 22A is an illustration of the MEA structure with AEM and perforated CEM, and different formic acid transport pathways.
Figure 22B:
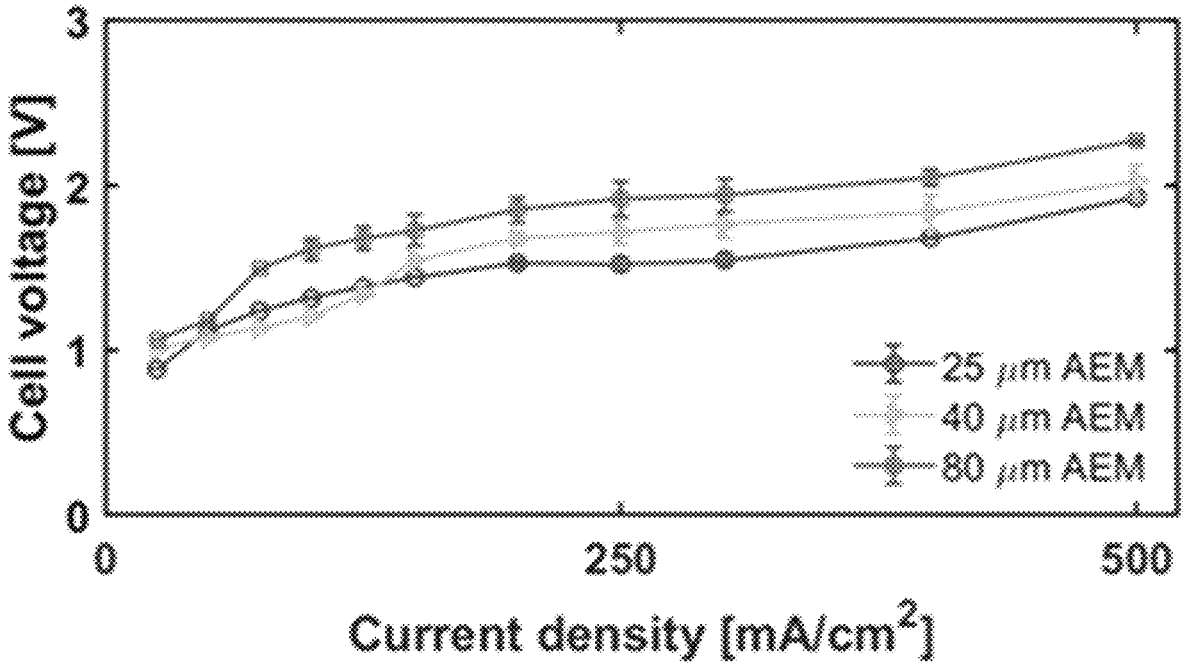
FIG. 22B shows cell voltage at different current densities with different AEM thicknesses.
Figure 22C:
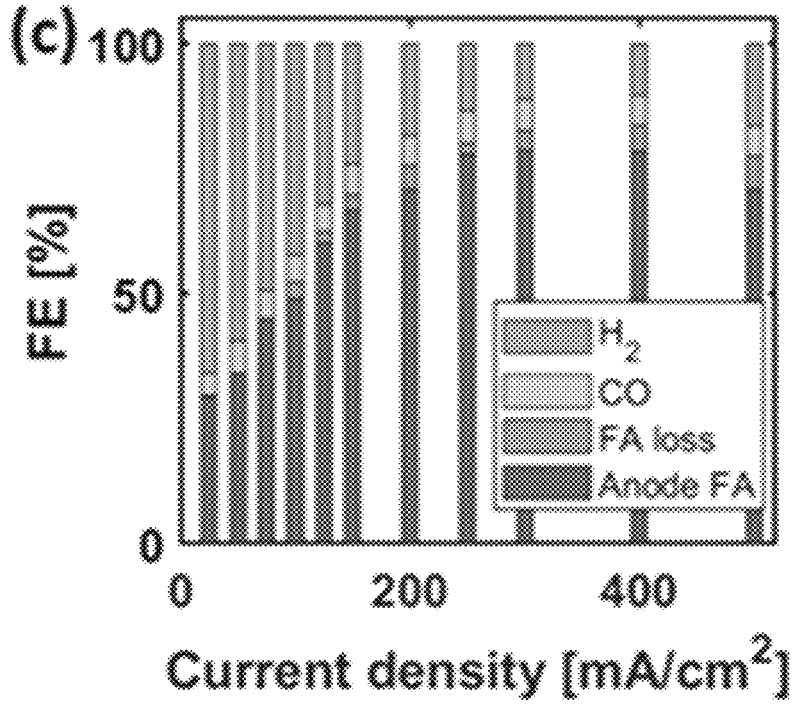
FIGS. 22C-22E provide FE at different current densities when the AEM thickness is 80 μm, 40 μm, and 25 μm, respectively.
Figure 22D:
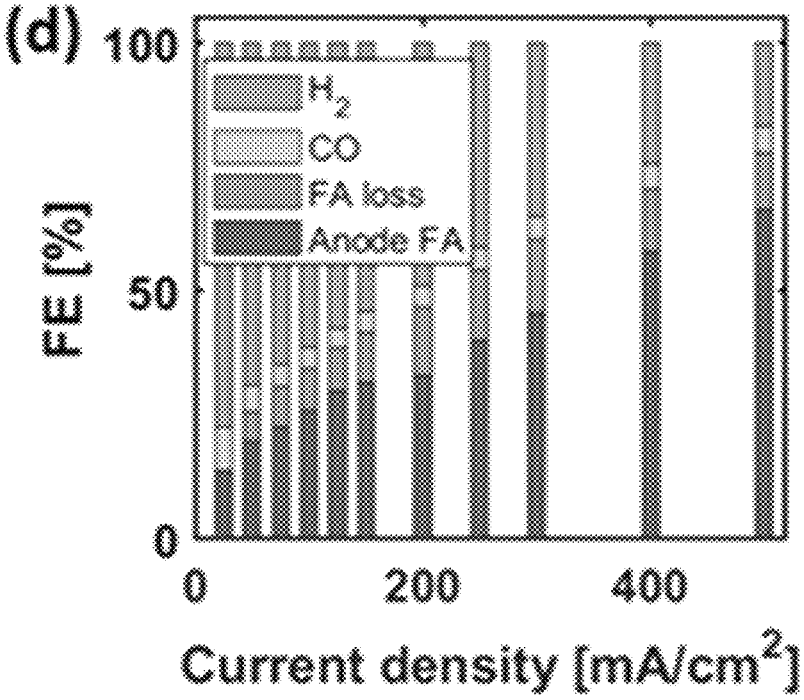
Figure 22E:
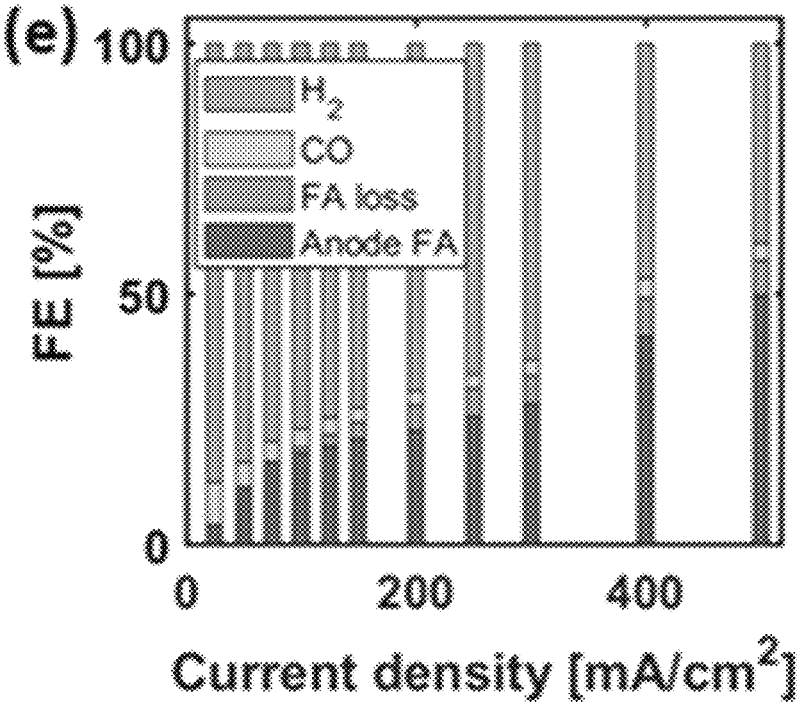

Based on the performance of the above-mentioned configurations, a new MEA architecture was targeted that: 1. produced formic acid, 2. limited formic acid oxidation, 3. leveraged currently commercially available materials, 4. leveraged fuel cell and electrolyzer components and designs, and 5. provided adequate electrode ionic conductivity with minimal electrolyte in an energy efficient system. A schematic for this architecture is shown in FIG. 1*c* and detailed further in FIG. 22A. Here, the PCEM layer provides pathways for formic acid and anions to migrate from the CEM/AEM interface, reducing species accumulation. Simultaneously, the PCEM pathways direct formic acid into the diffusion media and flow field, avoiding concentration build up near the Pt/C anode catalyst, reducing the likelihood for formic acid oxidation. Polarization results using 80, 40 and 25 μm thick AEMs are shown in FIG. 22B. It is important to mention that while most of the formic acid produced at the CEM/AEM junction can pass through the perforated channels on the CEM, there will inevitably be a localized area of high formic acid concentration at the interface. The high formic acid concentration gradient can lead to a small amount of formic acid directly diffusing through the CEM, with subsequent oxidation of formic acid at the anode. Additionally, formic acid will also diffuse back through the AEM to the cathode. Thus, while the total cell voltage increases with AEM the thickness, as expected, use of thicker AEMs prevents formic acid back diffusion, increasing cathode pH and reducing $H_2$ production (FIGS. 22C-22E).

Figure 22F:
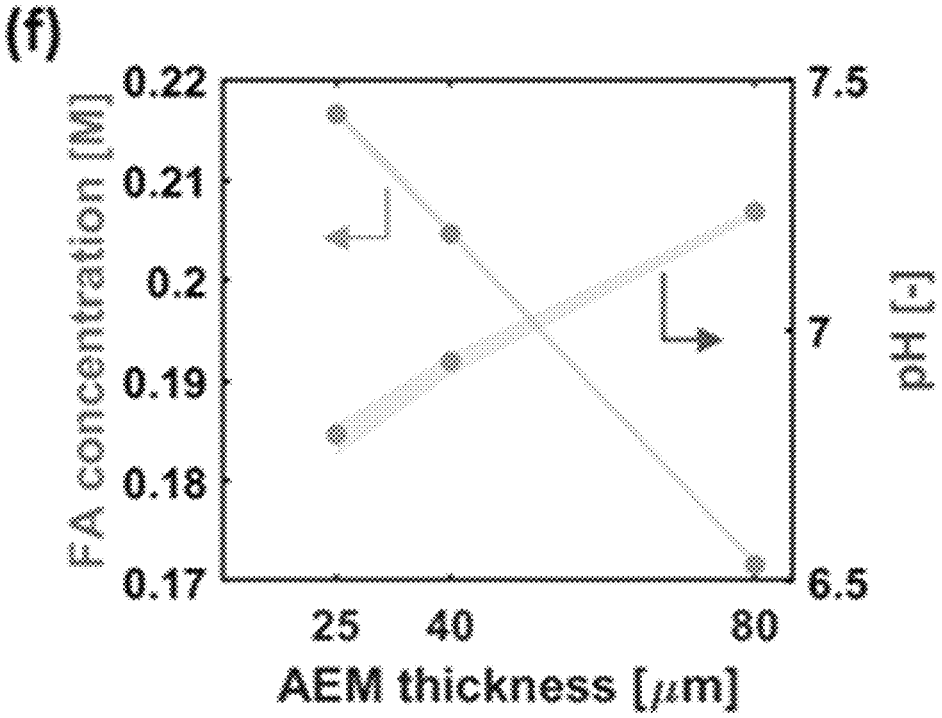
FIG. 22F provides simulation results of formic acid concentration and pH across the CEM/AEM interface with different AEM thicknesses.
Figure 22G:
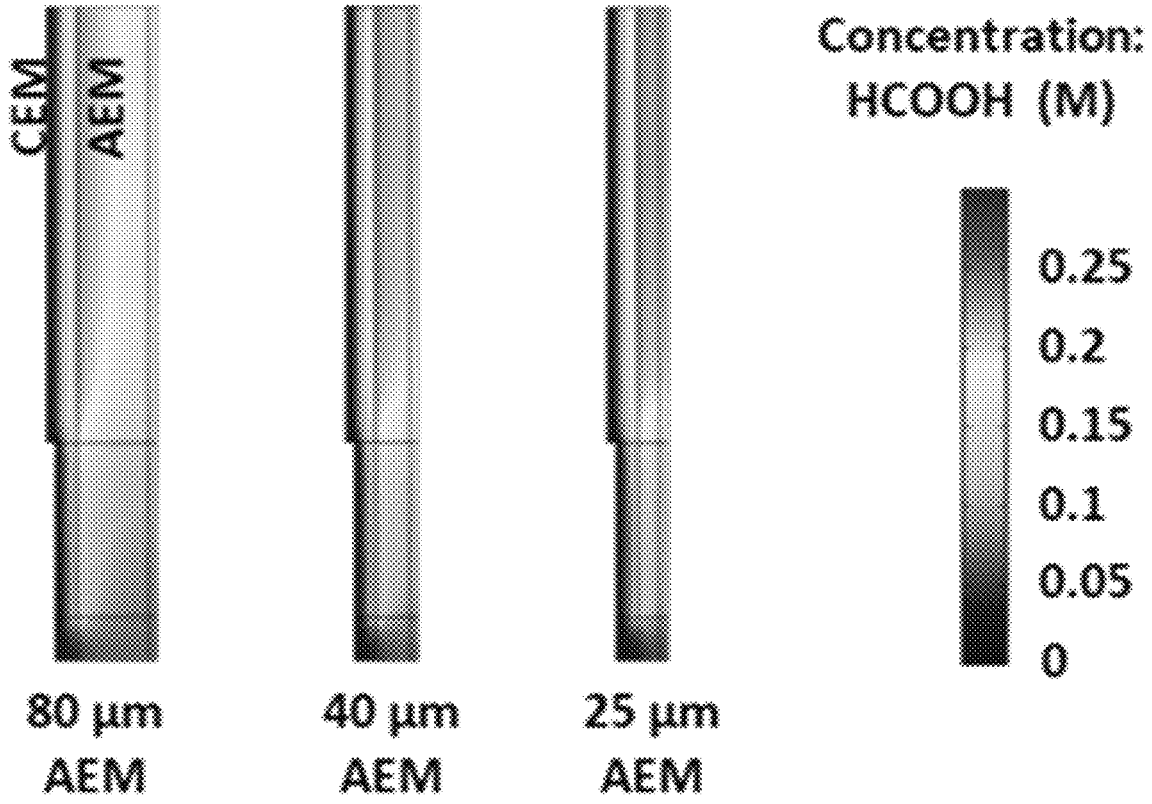
FIG. 22G is a 2D distribution of the formic acid concentration with CEM/AEM interface and perforation.
Figure 23:
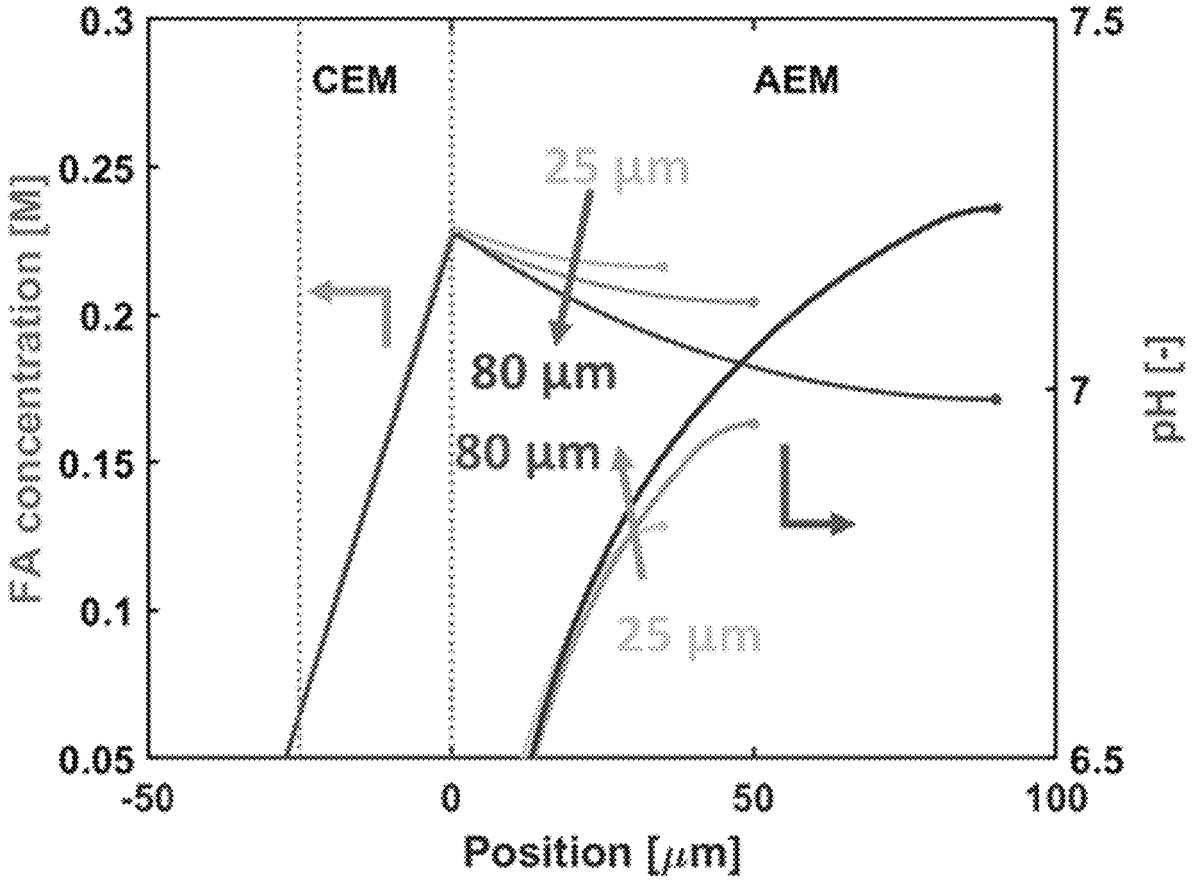
FIG. 23 provides simulation results of formic acid concentration and pH across the CEM/AEM interface with different AEM thicknesses.

FIG. 23 shows the formic acid concentration and pH distribution throughout the thickness direction of the MEA using finite element Poisson-Nernst-Plank simulation. It is not surprising that the CEM/AEM interface exhibits the greatest concentration of formic acid, 0.23 mol/L, as formic acid is produced at this interface. As the AEM thickness increases, there is a faster drop-off of formic acid concentration through the AEM, which suggests a greater mass transport resistance and a smaller flux of formic acid due to back diffusion. FIGS. 22F-22G show the resulting pH and formic acid within the cathode catalyst layer caused by back diffusion, and 2D formic acid concentration distribution, respectively. With thinner AEM membranes, the formic acid concentration near the cathode is higher and cathode pH becomes acidic. Therefore, while thicker AEM membranes lead to higher ohmic losses, they are critical to prevent formic acid back diffusion to the cathode and maximizing a high net system formic acid FE. Ultimately, increasing AEM thickness to 80 μm enabled >80% FE to formic acid at <2 V and 300 mA/cm$^2$ for a 25 cm$^2$ cell.

Figure 24A:
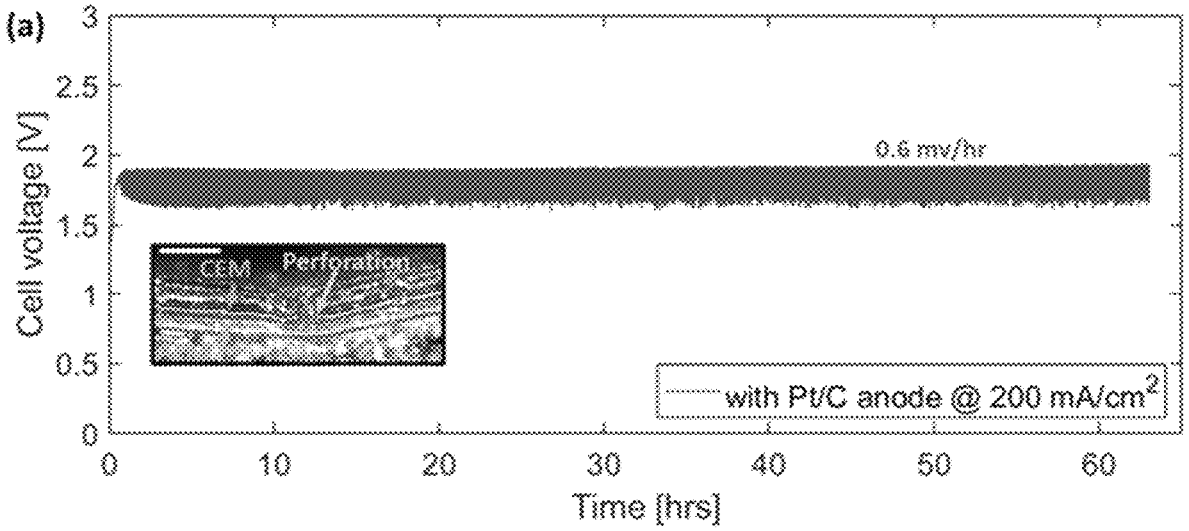
FIGS. 24A-24B describe the durability of the system with an 80 μm AEM and perforated CEM with a Pt/C anode at 60° C.
Figure 24B:
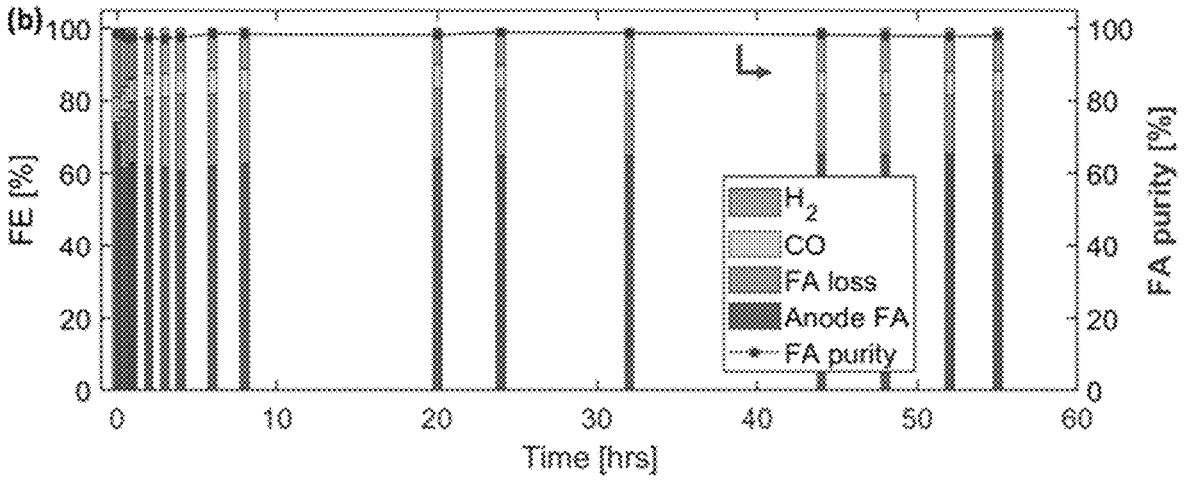
Figure 25A:
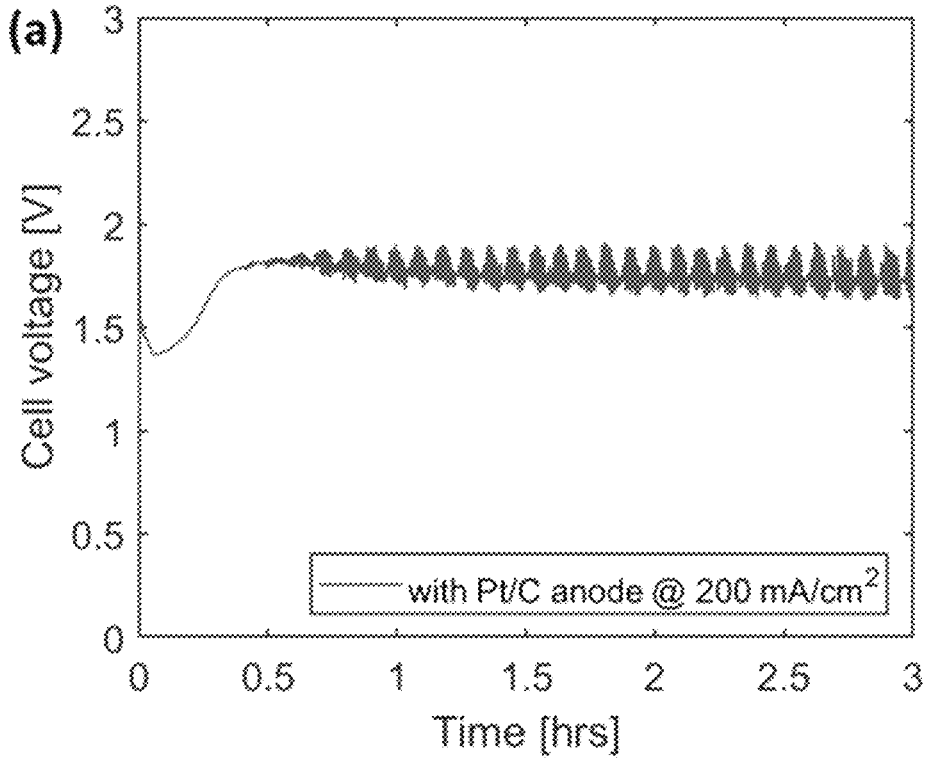
FIGS. 25A-25B describe the durability of the system with an 80 μm AEM and perforated CEM at 60° C.
Figure 25B:
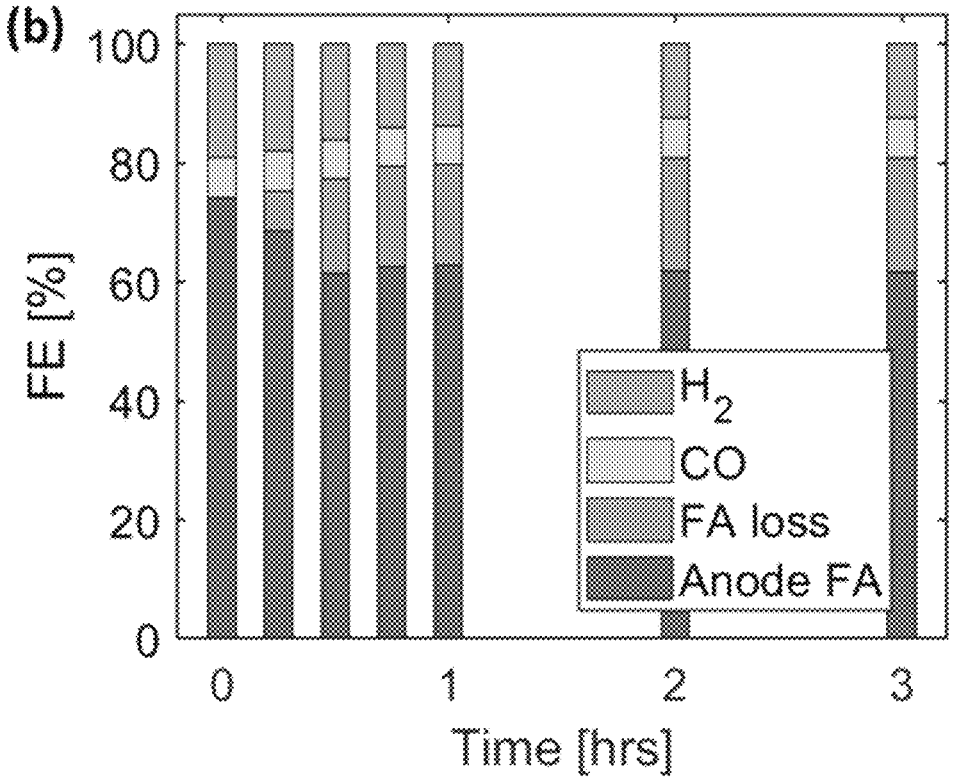

As described herein, beyond FE and energy efficiency, understanding system stability (degradation at constant conditions) and/or durability (degradation under dynamic conditions) is critical to mitigating losses and enabling scalable processes. To test the stability of the PECM based architecture, the cell was held at 200 mA/cm$^2$ for 55 hrs. The overall results are displayed in FIGS. 24A-24B with results from the first 3 hrs highlighted in FIGS. 25A-25B. When a Pt/C anode catalyst was used, the cell voltage increased dramatically, from 1.3 to 1.8 V, within the first 30 minutes (FIG. 25A). At longer durations, the cell voltage remained nearly constant, yielding a degradation rate of 0.6 mV/hr (FIG. 24A) At the beginning of test, the FE for formic acid collected at the anode is 76.5%, and the cathode FE for hydrogen is 19.2%. After the first hour of testing, the FE for hydrogen dropped to 13.8%, suggesting an improved selectivity for formate. However, the system FE for formic acid dropped to 62.7% at 1 hour, and the anode formic acid oxidation rate increased from near zero at the beginning of the test to 17.0%. Subsequently, the FE for $H_2$. CO, formic acid, and the anode formic acid oxidation rate remained stable for the duration of the experiments. The increase of formic acid oxidation over the first hour is likely related to formic acid accumulation at the PCEM/AEM interface. As the concentration of formic acid builds up, it will not only exit through membrane perforations but also via diffusion through the CEM itself, entering the Pt/C anode layer. Since formic acid is a liquid at 60° C., its accumulation can cause mass transport issues and lead to preferential oxidation over hydrogen gas.

Figure 26A:
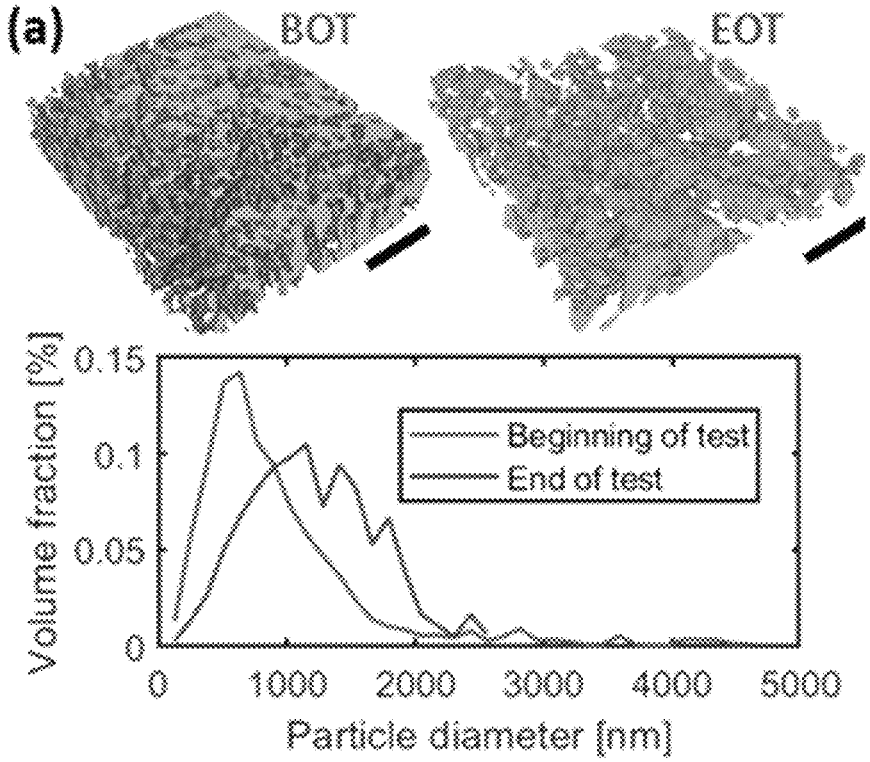
FIGS. 26A-26B provide characterization results for beginning of test and end of test (55-hours stability tested) $Bi_2O_3$ cathode samples and results of in-situ X-ray spectroscopy studies of $Bi_2O_3$.
Figure 26B:
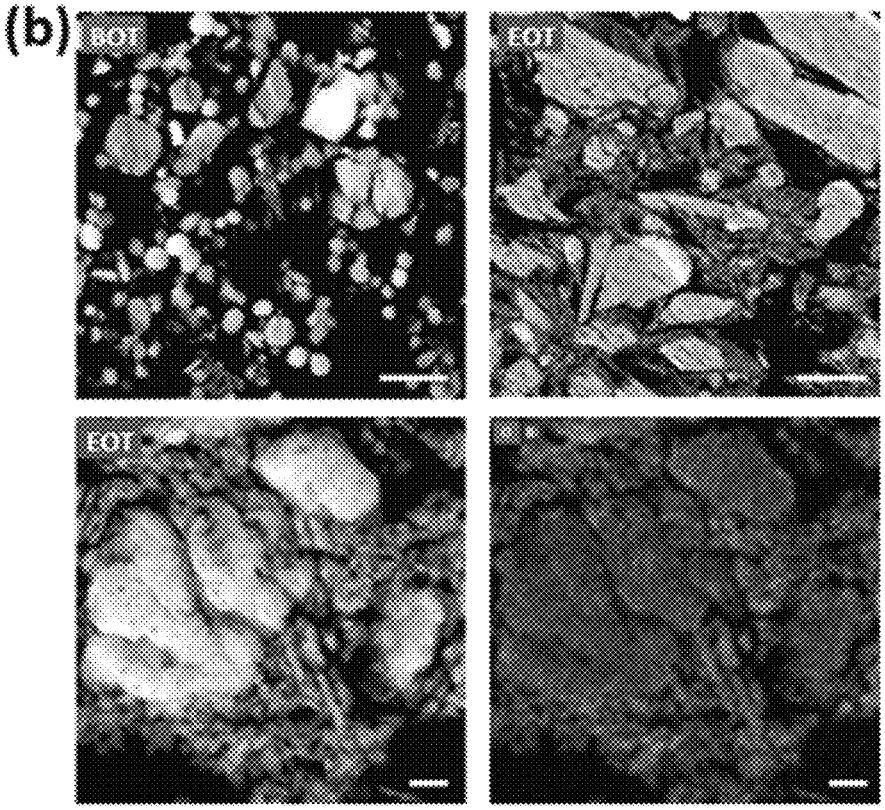
Figure 26C:
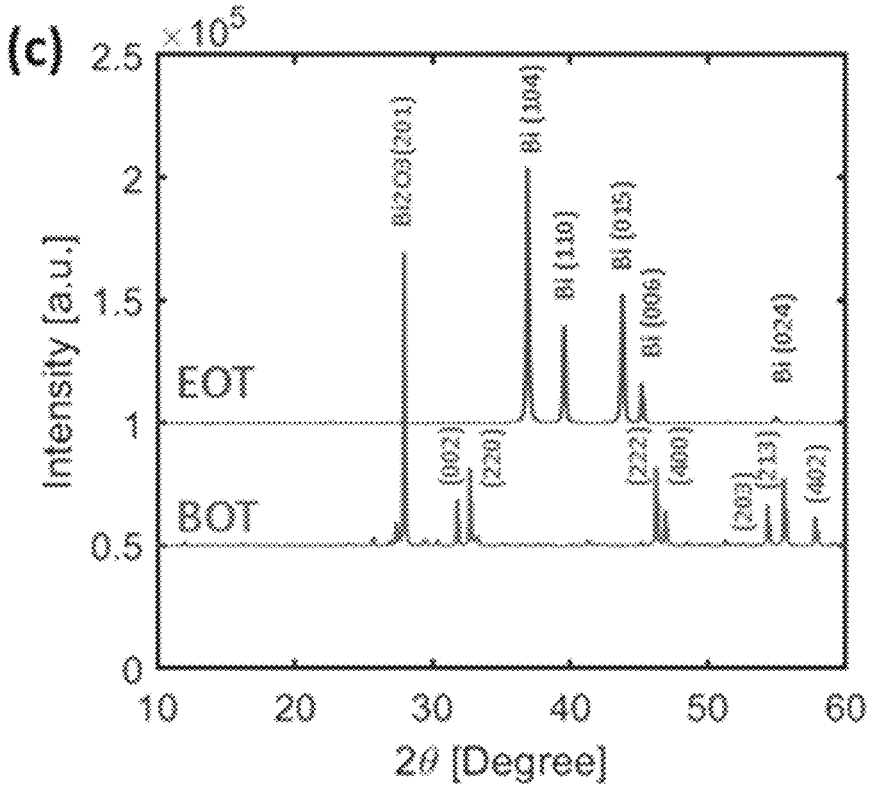
FIG. 26C shows XRD patterns of the BOT and EOT cathode samples.
Figure 26D:
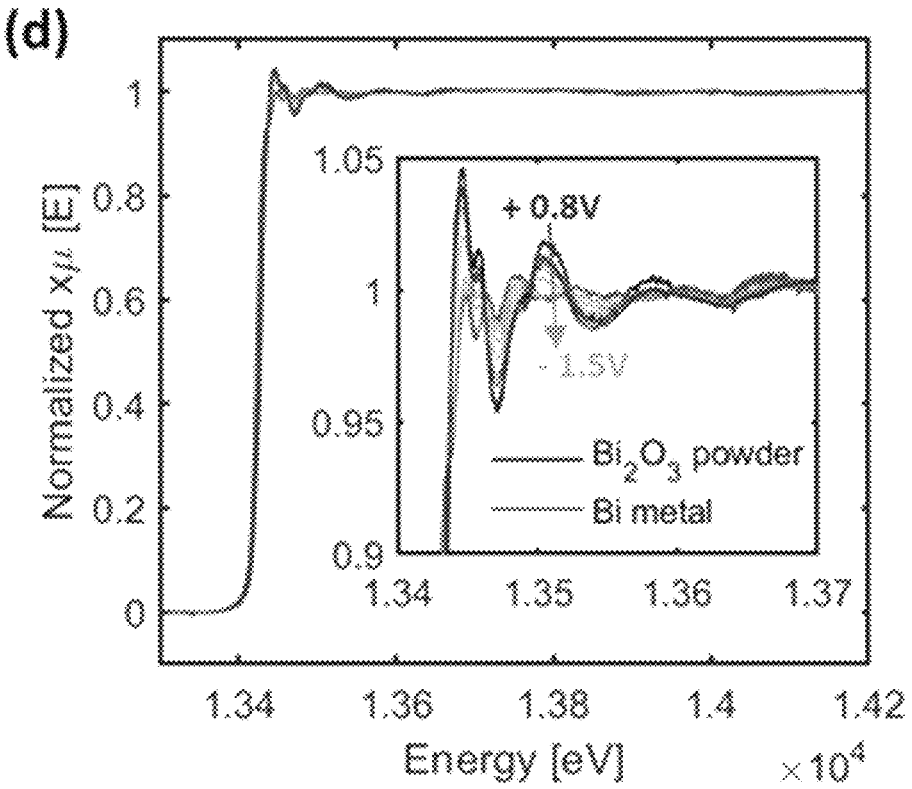
FIG. 26D provides in-situ X-ray absorption spectra of the $Bi_2O_3$ electrode in 0.1 M KOH as a function of potential (0.8 V to −1.5 V vs RHE).

To elucidate degradation mechanisms, the morphology for both beginning-of-test (BOT), as prepared, and end-of-test (EOT), post 55-hr stability tested samples were characterized using nano-Xray computed tomography (nano-CT), as shown in FIG. 26A. Based on the 3D structure, the EOT sample has a larger catalyst particle size compared to the BOT sample. The average catalyst cluster grows from 930 nm to 1207 nm in diameter, likely also shifting from physically interacting aggregates to agglomerated structures. The High-angle annular dark-field scanning transmission electron microscopy (HAADF-STEM) image and energy-dispersive X-ray spectroscopy (EDS) results are shown in FIG. 26B. While the BOT catalyst layer contains a large portion of smaller catalyst particles, as well as some larger agglomerates, at the EOT, the catalyst layer can be divided into two separate regions: one with significantly larger solid particles and a more porous region containing a significant number of smaller particles. The EDS mapping shows that the large solid particles are Bi rich, likely metallic Bi, while the porous region is oxygen rich. When the cell is operated at 200 mA/cm$^2$, the negative potential at the cathode will lead to reduction of $Bi_2O_3$, as evidenced by in situ X-ray absorption spectroscopy results discussed below. The HAADF-STEM and EDS mapping results indicate that certain particles of $Bi_2O_3$ undergo a reduction process, causing them to lose oxygen and coalesce into larger metallic particles. Simultaneously, Bi from smaller particles may reattach to the larger metallic cores, resulting in an increase in the size of those particles. X-ray diffraction (XRD) patterns of the BOT and EOT cathodes support the interpretation of the EDS data (FIG. 26C): with only crystalline $Bi_2O_3$ detected in the BOT cathode and crystalline Bi metal detected at the EOT. To understand the effect of cathode potential on the oxidation state of the $Bi_2O_3$ cathode catalyst, in-situ X-ray absorption spectra (XAS) were acquired at the Bi $L_3$ absorption edge in 0.1 M KOH from the open circuit potential (+0.3 V vs RHE) to −1.5 V vs RHE. The onset of the reduction of the $Bi_2O_3$ phase at −0.85 V vs RHE was observed, as indicated by a decrease in the white line intensity in the near-edge region of the spectrum, with 90% reduction to Bi metal at −1.1 V vs RHE (FIG. 26D). Regardless of the mechanism and despite the pronounced change in cathode morphology, catalyst oxidation state and crystallite structure, overall formate selectivity in the cathode, inferred from $H_2$ and CO FE along with formic acid production, remains largely unaffected.

Figure 27A:
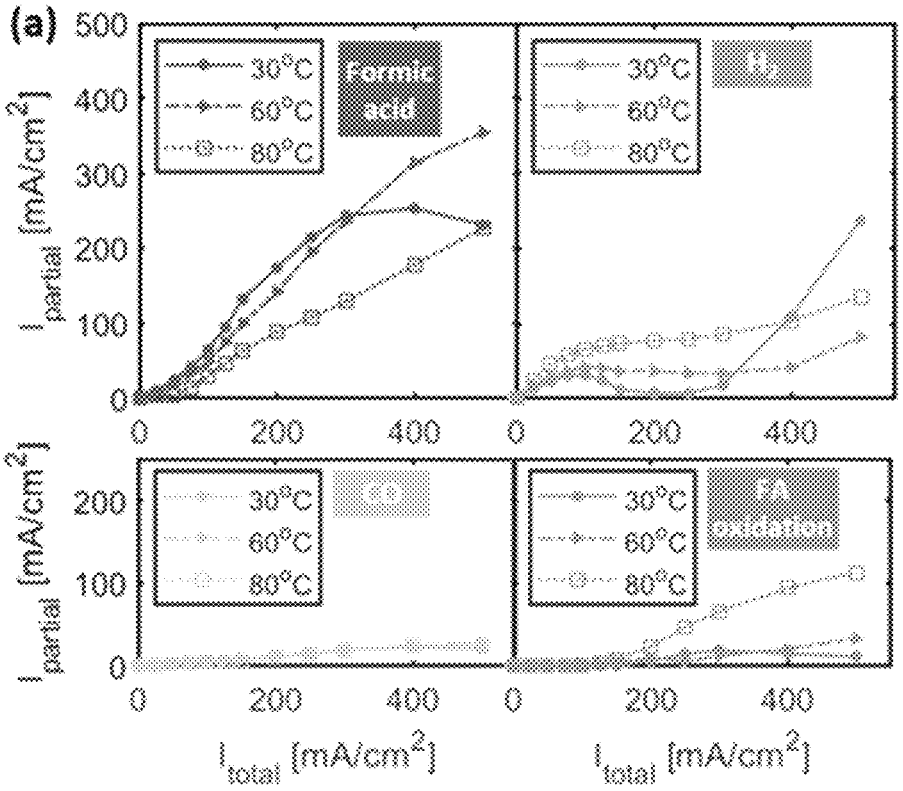
FIG. 27A shows partial current densities for different reactions when the cell is operated at 30, 60, and 80° C. with Pt/C anode and 80 μm AEM.
Figure 27B:
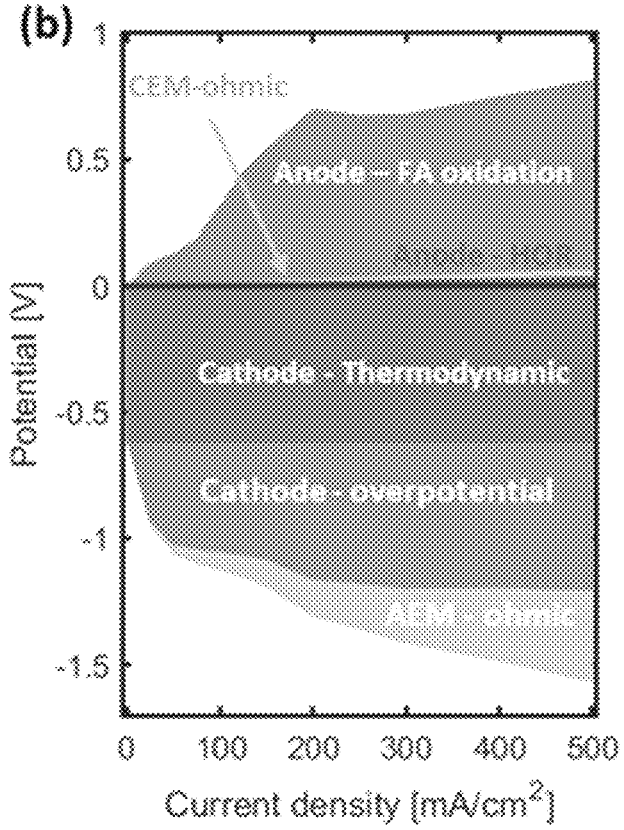
FIG. 27B shows the cell voltage breakdown using $H_2$ reference electrode of the cell operated at 60° C. with Pt/C anode and 80 μm AEM.

Cell operating conditions can play a role in the transport, accumulation, and kinetics for formic acid oxidation. With a similar boiling point to water (100.8 vs 100° C. at 101.3 kPa), the transport and accumulation of formic acid will be impacted by cell temperature. FIG. 27A displays partial current densities as a function of temperature. As operating temperature increases, formic acid FE decreases, which is accompanied by the increased partial current density for hydrogen evolution reaction (HER). The rate for formic acid oxidation is also higher at higher temperatures, while in contrast, CO production is less sensitive to the temperature change.

To quantify exactly how much opportunity exists to improve the energy efficiency as formic acid oxidation is suppressed, a $H_2$ reference electrode was used to discern voltage loss contributions. At current densities below 500 mA/cm$^2$, the cathode potential remained lower than −1.25 V. The anode potential is divided into two main parts, the theoretical overpotential of HOR predicted by the HOR exchange current density and Bulter-Volmer equation from previous measurements, and the remainder attributed to formic acid oxidation. A small rate of formic acid oxidation reaction at the anode can lead to a significant increase in the anode potential due to its much slower reaction kinetics compared to HOR. The result indicates that nearly 500 mV of overpotential can be eliminated by completely suppressing anode formic acid oxidation.

Figure 27C:
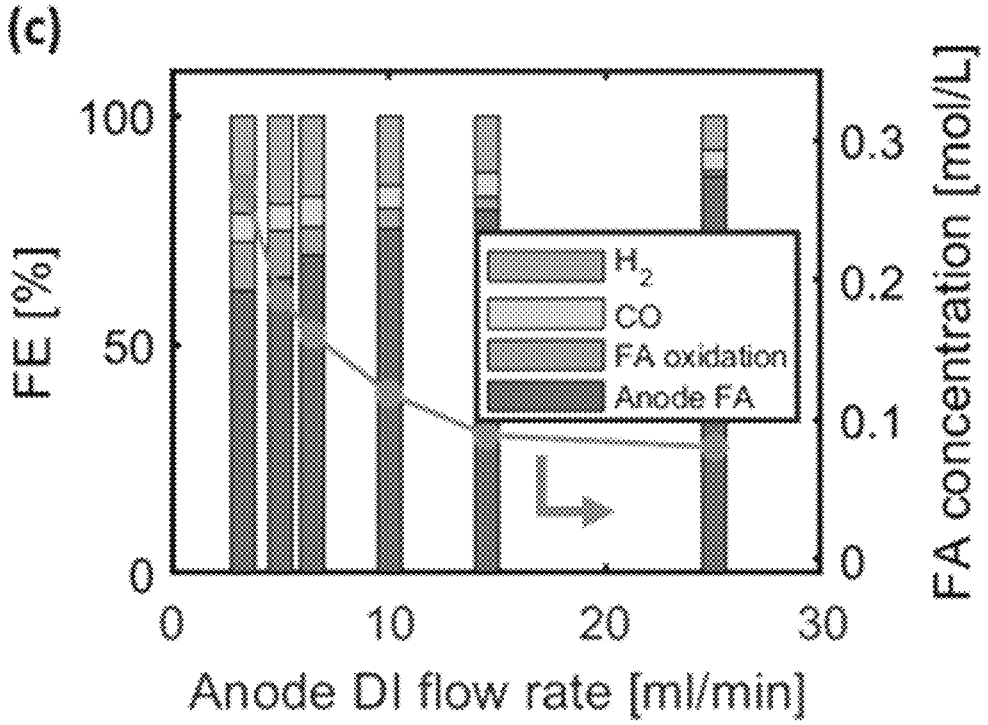
FIG. 27C provides FE and formic acid concentrations collected at 200 $mA/cm^2$ with different anode DI water flow rate.
Figure 27D:
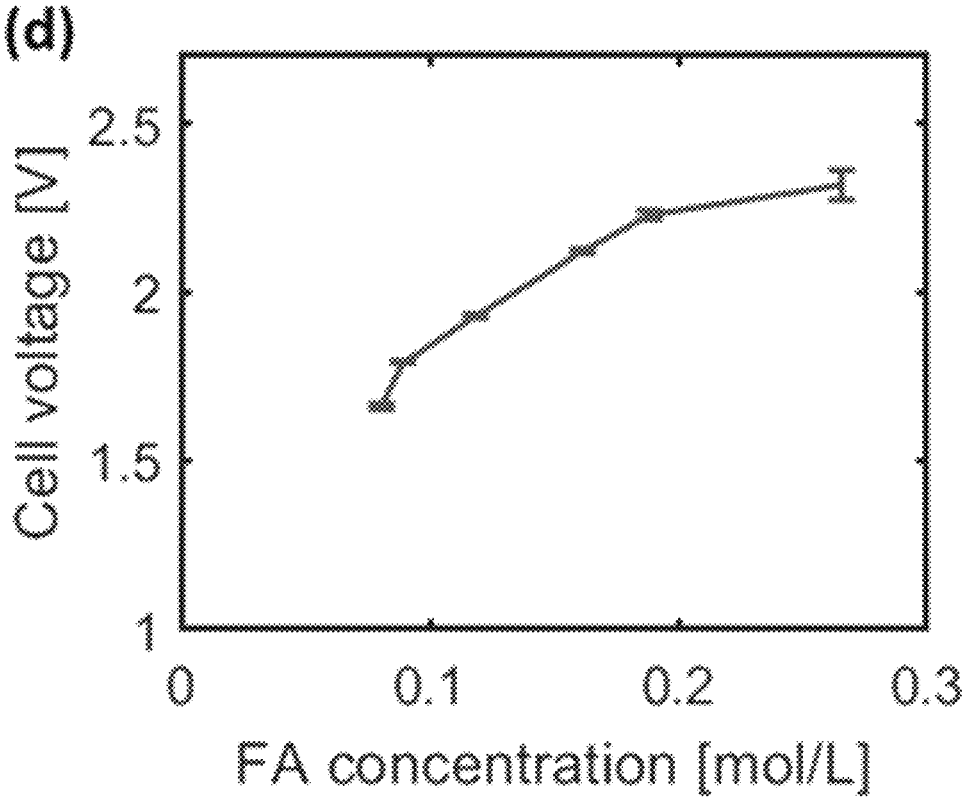
FIG. 27D provides cell voltage at 200 $mA/cm^2$ when different concentrations of formic acid are collected at the anode.

To test this assessment, the deionized water (DI) flow rate was varied on the anode inlet to reduce formic acid effluent concentration. FIGS. 27C-27D show the resulting FE, formic acid concentrations and cell voltages at 200 mA/cm$^2$ as a function of anode DI flow rate. As the DI flow rate increased from 3.3 mL/min to 25 mL/min, formic acid anode concentration decreases from 0.27 to 0.08 mol/L. The reduced concentration improved overall formic acid FE, decreasing $H_2$ FE, as cathode pH becomes more basic due to reduced back diffusion of formic acid. The reduced formic acid concentration at the highest DI flow rate also nearly eliminates formic acid oxidation, pushing the overall cell voltage to just below 1.7 V at 200 mA/cm$^2$. When viewed as a complete system, technoeconomic analysis will need to be utilized to inform the best combination of stack operating conditions relative to subsequent distillation to the 85 wt. % formic acid commercial standard. Nevertheless, whether through the use of anode catalysts with improved $H_2$ to formic acid selectivity, or device operation, PCEM based architectures achieve vastly improved energy efficiency when formic acid oxidation is suppressed.

Conclusions

In summary, we investigated several zero-gap MEA configurations for $CO_2$ to formic acid reduction and proposed a novel structure that contains a composite forward bias bipolar membrane including a perforated cation exchange membrane (PECM) to facilitate the mass transport of formic acid generated at the membrane interface. This configuration generated >96% formic acid up to 0.25M (using an anode DI flow rate of 3.3 mL/min). At higher DI flow rates (25 mL/min), the configuration yielded >80% FE 200 mA/cm$^2$ current density at 1.7 V using a 25 cm$^2$ cell. At moderated anode DI flow rates (10 mL/min) the PECM configuration maintained a stable voltage and high FE for formic acid over a 55 hr test at 200 mA/cm$^2$. The high stability and selectivity achieved with commercially available catalysts and polymer membrane materials can be further amplified by combining it with optimized electrocatalysts. The approach for $CO_2$ for formic acid presented here, eliminates the need for anolyte and catholyte chambers, interlayer components, and specialized materials thereby improving cell energy efficiency and reducing system complexity to facilitate system scale up.

Methods

Cathode Gas Diffusion Electrode Fabrication—All materials and reagent grade solvents were used as received unless otherwise noted. Bismuth oxide catalyst ($Bi_2O_3$, 80 nm) was purchased from US Research Nanomaterials, Inc. The polymer (AP1-CNN8-00-X) powder was supplied by IONOMR. Omnisolv® grade n-propanol (nPA) and ultra-pure water (18.2Ω, Milli-Q® Advantage A10 Water Purification System) were obtained from Millipore Sigma. ACS Certified methanol and acetone were purchased by VWR Chemicals BDH® and Fisher Chemical, respectively. The polymer powder was combined in a 1:1 weight mixture of acetone and methanol to render a 6.5 wt. % polymer dispersion. The catalyst ink was prepared by combining 20 g of $Bi_2O_3$, ultra-pure water, nPA, and ionomer dispersion into a 30 mL jar. This formulated recipe contained 30 wt. % catalyst, an ionomer-to-catalyst weight ratio of 0.02, and an alcohol-to-water weight ratio of 2:3 (40 wt. % nPA). 70 g of Glen Mills 5 mm zirconium oxide grinding media were added to this mixture prior to mixing. Samples were placed on a Fisherbrand™ Digital Bottle Roller at 80 rpm for 26 hrs. Inks were allowed to settle for 20 min before coating. $Bi_2O_3$ inks were coated at 22° C. utilizing a ½"×16" wire wound lab rod (RD Specialties—60 mil diameter) on a Qualtech automatic film applicator (QPI-AFA6800). 5 mL of catalyst ink deposited on 7.5"×8" Sigracet 39 BB carbon gas diffusion media (Fuel Cell Store) were rod coated at a fixed average speed of 55 mm/sec. These coated electrodes were transferred to an oven and dried at 80° C.

Membrane Electrode Assembly—For the composite membrane configuration that contains anion exchange membrane (AEM) and perforated CEM. Nafion NC700 (Chemours, USA) with a nominal thickness of 15 μm is used as the CEM layer. The anode catalyst was directly spray coated on the CEM, with an ionomer to carbon ratio of 0.83, and a coating area of 25 cm$^2$. High surface area supported platinum (50 wt. % Pt/C, TEC 10E50E, TANAKA precious metals) with a loading of 0.25 mg/cm$^2$ was used as the anode catalyst. Nafion D2020 (Ion Power, USA) was used as the anode catalyst layer ionomer. The CEM perforation was conducted by cutting parallel lines on the CEM membrane with a spacing of 3 mm. During cell assembly, the perforated catalyst coated CEM membrane was place on a 25 $cm^2$ Toray paper (5 wt. % PTFE treated, Fuel Cell Store, USA). An AEM membrane (PiperION, Versogen, USA) was placed on top of the CEM and the cathode GDE on top of the AEM. A PTFE gasket was used for both anode and cathode with thicknesses to achieve an optimum GDE compression of 18%.

Electrochemical Testing: During the test, the assembled cell was held at 60° C. (for temperature dependent study, 30, 60 and 80° C.), with the anode supplied with 0.8 slpm hydrogen and cathode supplied with 2 slpm $CO_2$ gas. Both anode and cathode gas stream were humidified with a relative humidity of 100%, and a cathode back pressure of 37.6 kPa. During the operation, the cathode gas stream was mixed with 2 mL/min of 1 molar KOH, to facilitate cathode catalyst layer utilization and ion conduction. The anode gas stream was mixed with 10 mL/min DI water, to help remove formic acid at the anode. The electrochemical testing was conducted using a Garmy Potentiostat (Reference 30K, Gamry, USA). The cell was conditioned using liner scanning voltammetry from 0 to 250 mA/$cm^2$ for 4 times with a scan rate of 2.5 mA/$cm^2$ prior to polarization curve measurement. The polarization curves were obtained using galvanostatic mode, with the cell held at certain current densities for 4 mins before collecting cathode gas and anode liquid sample.

Reference Electrode and Voltage Breakdown: We used a hydrogen reference electrode in the MEA to separate the cathode and anode potentials. The structure of the reference electrode is shown in FIG. S6*a*. A strip of Nafion membrane (Nafion 211, IonPower, USA) is used as the ion bridge to connect the MEA membrane with the reference electrode. One end of the Nafion strip was connected to a 1 $cm^2$ gas diffusion electrode (GDE) that has a loading of 0.25 mg Pt/$cm^2$ (50 wt. % Pt/C, TEC10E50E, TANAKA precious metals) spray coated on 29BC carbon paper (Fuel Cell Store, USA). Custom-made Polyether ether ketone (PEEK) hardware was used for gas sealing and to guarantee good contact between the GDE and the Nafion strip, as well as to connect the reference electrode to the fuel cell hardware. The other end of the Nafion strip was linked to an overhanging edge of the cell's CEM.

Product Quantification: The gas samples were collected from the cathode, after the effluent gas passed through the condenser and gas-liquid separator. The collected gas was analyzed using a 4900 Micro GC (10 m, molecular sieve, Agilent) at least three times. Samples were collected in Supel™ Inert Multi-Layer Foil Gas Sampling Bags (Sigma-Aldrich) for a specific duration (30 seconds) and manually inserted into the Micro GC within two hours of collection. The injection temperature was set to 110° C. Carbon monoxide (CO) and hydrogen ($H_2$) were separated within a heated (105° C.) and pressurized (28 psi) 10 m MS5A column using argon (Matheson Gas-Matheson Purity) as the carrier gas. The compounds were detected on an integrated thermal conductivity detector (TCD). The GC chromatogram and calibration curves of CO and $H_2$ are shown in FIG. S7. Liquid formic acid sample were collected from the anode with a certain period (120 seconds) and filtered with PTFE 0.22 μm syringe filters into 2 mL vials. The liquid products in the vials were analyzed using an Agilent 1260 Infinity II Bio-inert High-Performance Liquid Chromatography (HPLC) system, where a 20 μL sample volume was injected via autosampler (G5668A) with a mobile phase of 4 mM sulfuric acid ($H_2SO_4$) flowing at 0.6 mL/min (G5654A quaternary pump). The products were separated on a heated (35° C., G7116A column thermostat) Aminex HPX-87H 300×7.8 mm Column (Bio-Rad) with a preceding Micro-Guard Cation H guard column. Formic acid was detected on a Diode Array Detector (DAD) at 210 nm with a bandwidth of 4 nm.

Faradaic Efficiency, and Formic Acid Purity Calculation:

Liquid product (Formic acid) FE is calculated using equation 1, $$FE_{formic\ acid} = \frac{n_i * F * C_i * V}{j * A * t} \quad \text{(Eq. 1)}$$

The gas product (CO and $H_2$) FE are calculated using the following equation, with the total mol of gas calculated using ideal gas equation:

$$FE_{gas} = \frac{n_i * F}{j * A * t} * \frac{P * x_i}{R * T} \quad \text{(Eq. 2)}$$

Where:

$n_i$: number of electrons for the electrochemical reaction.
F: Faraday's constant.
$C_i$: Concentration of the liquid product from HPLC.
V: Volume of the collected liquid sample over fixed time t.
j: Current density.
A: Geometric area of the electrode (25 $cm^2$).
t: Time period for the sampling.
P: Absolute pressure
$x_i$: gas mol % as quantified by the GC.
R: gas constant.
T: Temperature The anode cation concentrations are quantified using inductively coupled plasma atomic emission spectroscopy (ICP-OES). Cations that could leach or diffuse into the anode include, Ti, Pt, Bi and K. All the other cations were below the detection limit except K. The formate ion in the anode effluent solution is either paired with proton or other cations. Thus, the formic acid purity can be calculated as:

$$P_{FA} = \frac{C_{HCOO-} - C_{K+}}{C_{HCOO-}} \times 100\% \quad \text{(Eq. 3)}$$

Nano-Xray computed tomography (nano-CT): BOT and EOT cathode GDE samples were tested using Zeiss Xradia 800 Ultra, with an X-ray source of 8.0 keV, absorption and large field of view mode with image binning 1. 901 images were collected from angle −90° to 90° and exposure time of 50 s. The reconstruction was performed using filter back projection method and has a voxel size of 64 nm. The segmentation and particle size distribution analysis were conducted with custom written code.

HAADF STEM: The electron microscopy characterizations involved embedding tested MEAs in epoxy in preparation for diamond knife ultramicrotomy. Cross sections of each MEA were cut to a thickness between 50 and 75 nm. The Talos F200X transmission electron microscope (Thermo Fisher Scientific) was used for scanning transmission electron microscopy (STEM) and energy-dispersive X-ray spectroscopy (EDS) measurements. The microscope was equipped with Super-X EDS system with 4 SDD windowless detectors and operated at 200 kV.

XRD characterizations: Powder X-ray diffraction (PXRD) patterns were acquired on a Bruker Advance D8

Powder X-ray Diffractometer with Ni-filtered Cu Kα radiation operating at 40 kV and 40 mA. The scan range was between 10° and 60° with 0.005° steps at a collection speed of 1 s/step.

In-situ aqueous cell: A home-made cell was utilized for measuring XAS spectra at the Bi $L_3$ edge for the $Bi_2O_3$ catalyst as a function of potential. A $Bi_2O_3$ catalyst-ionomer ink was prepared using 26.1 mg $Bi_2O_3$ mixed with 156.3 μL of ionomer solution (6.68%), neutralized with 1 M KOH, water (157 μL), and isopropanol (104 μL) giving an ionomer-to-catalyst ratio of 0.4. The ink was deposited in rectangular spots (10 mm×4 mm) onto a graphene sheet to achieve a catalyst loading of 0.5 mg/cm$^2$ of $Bi_2O_3$. The remainder of the graphene sheet was covered with Kapton to insulate these areas from the electrolyte. The catalyst-coated graphene sheet was inserted between two PTFE and screwed onto the cell body (PEEK), FIG. S8. The reference electrode was Hg/HgO (1M NaOH) and the counter electrode carbon paper. The Hg/HgO reference electrode was calibrated versus a Pt wire immersed in hydrogen-saturated 0.1 M KOH for the conversion of all measured potentials to the reversible hydrogen electrode (RHE) scale. The XAS spectra were acquired while controlling the potential of the $Bi_2O_3$/graphene sheet working electrode immersed in 0.1 M KOH heated to 30° C. The electrolyte was circulated through the cell, with electrolyte inlet at the bottom on the cell and outlet at the top to ensure electrolyte contact with the catalyst layer in the event of bubble formation. The potential of the working electrode was controlled using a CH Instruments 760e potentiostat. The potential sequence was: open circuit potential, −100, −200, −300, −400, −500, −800, −850, −900, −1000, −1100, −1500, and +700 mV vs RHE. All potentials have been iR corrected.

XAFS experiments: Bi $L_3$ edge (~13424 eV for Bi metal) X-ray absorption fine structure (XAFS) spectra were measured in fluorescence mode at the Materials Research Collaborative Access Team (MRCAT) beam line 10-ID, Advanced Photon Source (APS), Argonne National Laboratory. The X-ray energy was tuned using a liquid nitrogen-cooled Si(111) double crystal monochromator, while the harmonic content was attenuated using a Rh-coated mirror. The scan energy range was 13200 eV to 14400 eV, and the fluorescence was measured using a 5×5 silicon PIN diode grid array without filters or Soller slits. The energy was calibrated via the $L_2$ edge for a Pt foil to 13271.90 eV for the zero-crossing of the second derivative. Due to the thickness of the electrochemical cell, the spectrum for a reference standard was not measured simultaneously. Therefore, the estimated scan-to-scan variation of the incident X-ray energy was ±0.015 eV, based on repeated measurements over the course of the experiment. The thickness of the $Bi_2O_3$ layer resulted in some fluorescence self-absorption; the electrode remained in a fixed orientation with respect to the incident beam and detector, rendering the effect nearly identical for all scans. The near-edge regions of the XAFS spectra were utilized to determine the oxidation state and chemical speciation of bismuth by the comparison with the XANES region of Bi and $Bi_2O_3$ standards using linear combination fitting algorithm of the Athena software (version 0.9.26), based on the IFEFFIT code.

The described invention may be further understood by the following non-limiting examples:

Example 1. A device comprising:

an anode;

a cathode; and a cationic exchange membrane and an anionic exchange membrane positioned between the anode and cathode;

wherein at least one of the cationic exchange membrane and the anionic exchange membrane is a perforated ion exchange membrane;

wherein the device is an electrochemical cell for the conversion of carbon monoxide to organic compounds via electrolysis.

Example 2. The device of example 1, wherein the perforated ion exchange membrane has void space greater than or equal to 5% of a surface area of the perforated ion exchange membrane.

Example 3. The device of example 1 or 2, wherein the perforated ion exchange membrane comprises alternating parallel segments of membrane separated by void space.

Example 4. The device of any of examples 1-3, wherein perforated ion exchange membrane is a cathode catalyst coated membrane.

Example 5. The device of example 4, wherein the cathode catalyst coated membrane comprises Pt/HSC or Pt/V.

Example 6. The device of any of examples 1-5, wherein the perforated ion exchange membrane comprises Nafion.

Example 7. The device of any of examples 1-6, wherein the cathode is a gas diffusion electrode.

Example 8. The device of any of examples 1-7, wherein the cathode comprises a porous carbon electrode and a cathode catalyst.

Example 9. The device of any of examples 1-8, wherein the cationic exchange membrane is proximate to the anode and the anionic exchange membrane is proximate to the cathode.

Example 10. The device of any of examples 1-9, wherein the anion exchange membrane comprises a functionalized poly(aryl piperidinium) polymer.

Example 11. The device of any of examples 1-10, wherein the anode comprises a porous carbon electrode.

Example 12. The device of any of examples 1-11, wherein the anode comprises an anode catalyst.

Example 13. A device comprising:

an anode comprising a porous carbon electrode and an anode catalyst;

a cathode comprising a porous carbon electrode and a cathode catalyst;

a perforated cationic exchange membrane positioned between the anode and the cathode; and an anionic exchange membrane positioned between the anode and the cathode;

wherein the device is an electrochemical cell for the conversion of carbon monoxide to formic acid via electrolysis.

Example 14. The device of example 13, wherein the perforated ion exchange membrane has void space greater than or equal to 10% of a surface area of the perforated ion exchange membrane.

Example 15. The device of example 13 or 14, wherein the perforated ion exchange membrane comprises alternating parallel segments of membrane separated by void space.

Example 16. The device of any of examples 13-15, wherein perforated ion exchange membrane is a cathode catalyst coated membrane, positioned proximate to the anode.

Example 17. The device of any of examples 13-16 further comprising a second ion exchange membrane, which is anionic and positioned proximate to the cathode.

Example 18. The device of example 17, wherein the second ion exchange membrane is perforated.

Example 19. A method comprising:

providing an electrochemical cell comprising:

an anode;

a cathode; and a cationic exchange membrane and an anionic exchange membrane positioned between the anode and cathode;

wherein at least one of the cationic exchange membrane and the anionic exchange membrane is a perforated ion exchange membrane;

generating an electrical current between the anode and the cathode;

flowing carbon monoxide gas to the cathode, thereby reacting the carbon monoxide gas and generating organic compounds.

Example 20. The method of example 19, wherein the carbon monoxide gas further comprises potassium hydroxide, potassium bicarbonate or both.

Example 21. The method of examples 19 or 20, wherein the perforated ion exchange membrane has void space greater than or equal to 10% of a surface area of the perforated ion exchange membrane.

Example 22. The method of any of examples 19-21, wherein the perforated ion exchange membrane comprises alternating parallel segments of membrane separated by void space.

The provided discussion and examples have been presented for purposes of illustration and description. The foregoing is not intended to limit the aspects, embodiments, or configurations to the form or forms disclosed herein. In the foregoing Detailed Description for example, various features of the aspects, embodiments, or configurations are grouped together in one or more embodiments, configurations, or aspects for the purpose of streamlining the disclosure. The features of the aspects, embodiments, or configurations, may be combined in alternate aspects, embodiments, or configurations other than those discussed above. This method of disclosure is not to be interpreted as reflecting an intention that the aspects, embodiments, or configurations require more features than are expressly recited in each claim. Rather, as the following claims reflect, inventive aspects lie in less than all features of a single foregoing disclosed embodiment, configuration, or aspect. While certain aspects of conventional technology have been discussed to facilitate disclosure of some embodiments of the present invention, the Applicants in no way disclaim these technical aspects, and it is contemplated that the claimed invention may encompass one or more of the conventional technical aspects discussed herein. Thus, the following claims are hereby incorporated into this Detailed Description, with each claim standing on its own as a separate aspect, embodiment, or configuration.

The terms and expressions which have been employed herein are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments, exemplary embodiments and optional features, modification and variation of the concepts herein disclosed may be resorted to by those skilled in the art, and that such modifications and variations are considered to be within the scope of this invention as defined by the appended claims. The specific embodiments provided herein are examples of useful embodiments of the present invention and it will be apparent to one skilled in the art that the present invention may be carried out using a large number of variations of the devices, device components, methods steps set forth in the present description. As will be obvious to one of skill in the art, methods and devices useful for the present methods can include a large number of optional composition and processing elements and steps.

As used herein and in the appended claims, the singular forms "a", "an", and "the" include plural reference unless the context clearly dictates otherwise. Thus, for example, reference to "a cell" includes a plurality of such cells and equivalents thereof known to those skilled in the art. As well, the terms "a" (or "an"), "one or more" and "at least one" can be used interchangeably herein. It is also to be noted that the terms "comprising". "including", and "having" can be used interchangeably. The expression "of any of claims XX-YY" (wherein XX and YY refer to claim numbers) is intended to provide a multiple dependent claim in the alternative form, and in some embodiments is interchangeable with the expression "as in any one of claims XX-YY."

When a group of substituents is disclosed herein, it is understood that all individual members of that group and all subgroups, are disclosed separately. When a Markush group or other grouping is used herein, all individual members of the group and all combinations and subcombinations possible of the group are intended to be individually included in the disclosure. For example, when a device is set forth disclosing a range of materials, device components, and/or device configurations, the description is intended to include specific reference of each combination and/or variation corresponding to the disclosed range.

Every formulation or combination of components described or exemplified herein can be used to practice the invention, unless otherwise stated.

Whenever a range is given in the specification, for example, a density range, a number range, a temperature range, a time range, or a composition or concentration range, all intermediate ranges and subranges, as well as all individual values included in the ranges given are intended to be included in the disclosure. It will be understood that any subranges or individual values in a range or subrange that are included in the description herein can be excluded from the claims herein.

All patents and publications mentioned in the specification are indicative of the levels of skill of those skilled in the art to which the invention pertains. References cited herein are incorporated by reference herein in their entirety to indicate the state of the art as of their publication or filing date and it is intended that this information can be employed herein, if needed, to exclude specific embodiments that are in the prior art. For example, when composition of matter is claimed, it should be understood that compounds known and available in the art prior to Applicant's invention, including compounds for which an enabling disclosure is provided in the references cited herein, are not intended to be included in the composition of matter claims herein.

As used herein, "comprising" is synonymous with "including," "containing," or "characterized by," and is inclusive or open-ended and does not exclude additional, unrecited elements or method steps. As used herein, "consisting of" excludes any element, step, or ingredient not specified in the claim element. As used herein, "consisting essentially of" does not exclude materials or steps that do not materially affect the basic and novel characteristics of the claim. In each instance herein any of the terms "comprising", "consisting essentially of" and "consisting of" may be replaced with either of the other two terms. The invention illustratively described herein suitably may be practiced in the absence of any element or elements, limitation or limitations which is not specifically disclosed herein.

All art-known functional equivalents, of any such materials and methods are intended to be included in this invention. The terms and expressions which have been employed are used as terms of description and not of limitation, and there is no intention that in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims.

What is claimed is:

1. A device comprising:
an anode;
a cathode; and
a cationic exchange membrane and an anionic exchange membrane positioned between the anode and cathode;
wherein at least one of the cationic exchange membrane and the anionic exchange membrane is a perforated ion exchange membrane;
wherein the device is an electrochemical cell for the conversion of carbon monoxide to organic compounds via electrolysis;
wherein perforated ion exchange membrane is a cathode catalyst coated membrane.

2. The device of claim 1, wherein the perforated ion exchange membrane has void space selected from the range of 0.1% to 50% of a surface area of the perforated ion exchange membrane.

3. The device of claim 1, wherein the perforated ion exchange membrane comprises alternating parallel segments of membrane separated by void space.

4. The device of claim 1, wherein the cathode catalyst coated membrane comprises Pt/HSC or Pt/V.

5. The device of claim 1, wherein the perforated ion exchange membrane comprises Nafion.

6. The device of claim 1, wherein the cathode is a gas diffusion electrode.

7. The device of claim 1, wherein the cathode comprises a porous carbon electrode and a cathode catalyst.

8. The device of claim 1, wherein the cationic exchange membrane is proximate to the anode and the anionic exchange membrane is proximate to the cathode.

9. The device of claim 1, wherein the anion exchange membrane comprises a functionalized poly (aryl piperidinium) polymer.

10. The device of claim 1, wherein the anode comprises a porous carbon electrode.

11. The device of claim 1, wherein the anode comprises an anode catalyst.

12. A device comprising:
an anode comprising a porous carbon electrode and an anode catalyst;
a cathode comprising a porous carbon electrode and a cathode catalyst;
a perforated cationic exchange membrane positioned between the anode and the cathode; and
an anionic exchange membrane positioned between the anode and the cathode;
a second ion exchange membrane, which is anionic and positioned proximate to the cathode;
wherein the device is an electrochemical cell for the conversion of carbon monoxide to formic acid via electrolysis;
wherein the second ion exchange membrane is perforated.

13. The device of claim 12, wherein the perforated ion exchange membrane has void space greater than or equal to 10% of a surface area of the perforated ion exchange membrane.

14. The device of claim 13, wherein the perforated ion exchange membrane comprises alternating parallel segments of membrane separated by void space.

15. The device of claim 12, wherein perforated ion exchange membrane is a cathode catalyst coated membrane, positioned proximate to the anode.

16. A method comprising:
providing an electrochemical cell comprising:
an anode;
a cathode; and
a cationic exchange membrane and an anionic exchange membrane positioned between the anode and cathode;
wherein at least one of the cationic exchange membrane and the anionic exchange membrane is a perforated ion exchange membrane;
wherein perforated ion exchange membrane is a cathode catalyst coated membrane;
generating an electrical current between the anode and the cathode;
flowing carbon monoxide gas to the cathode, thereby reacting the carbon monoxide gas and generating organic compounds.

17. The method of claim 16, wherein the perforated ion exchange membrane has void space greater than or equal to 10% of a surface area of the perforated ion exchange membrane.

* * * * *